US006792219B2

(12) United States Patent
Hisada

(10) Patent No.: US 6,792,219 B2
(45) Date of Patent: Sep. 14, 2004

(54) TRANSFER CONTROL FOR AN IMAGE FORMING APPARATUS

(75) Inventor: Hidenori Hisada, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/397,335

(22) Filed: Mar. 27, 2003

(65) Prior Publication Data

US 2003/0185581 A1 Oct. 2, 2003

(30) Foreign Application Priority Data

Mar. 28, 2002 (JP) ..... 2002-091285

(51) Int. Cl.[7] ..... G03G 15/00; G03G 15/16
(52) U.S. Cl. ..... 399/45; 399/66; 399/313
(58) Field of Search ..... 399/44, 45, 66, 399/297, 313, 314

(56) References Cited

U.S. PATENT DOCUMENTS

| | | | | | |
|---|---|---|---|---|---|
| 5,530,522 | A | * | 6/1996 | Tsunemi | 399/66 |
| 5,596,391 | A | * | 1/1997 | Matsushita et al. | 399/45 |
| 5,682,575 | A | * | 10/1997 | Komori | 399/66 |
| 5,893,661 | A | * | 4/1999 | Sakai et al. | 399/66 |
| 5,999,760 | A | * | 12/1999 | Suzuki et al. | 399/45 |
| 6,205,299 | B1 | * | 3/2001 | Kusaka et al. | 399/45 |
| 6,654,570 | B2 | * | 11/2003 | Kato | 399/66 |

FOREIGN PATENT DOCUMENTS

| | | | | |
|---|---|---|---|---|
| JP | A 2-272590 | | 11/1990 | |
| JP | 06-161295 | * | 6/1994 | G03G/15/16 |
| JP | A 10-207262 | | 8/1998 | |
| JP | 11-065324 | * | 3/1999 | G03G/15/16 |

* cited by examiner

*Primary Examiner*—Fred Braun
(74) *Attorney, Agent, or Firm*—Oliff & Berridge, PLC

(57) ABSTRACT

A transfer bias applying power supply 81 applies a transfer bias current of a fixed amount to a transfer roller 31 by executing a constant current control operation. A voltmeter 78 measures the amount of voltage generated by the transfer roller 31. The generated voltage amount indicates the resistance of the transfer roller 31. A sheet type detecting program is executed to detect the size and thickness of a sheet 3. An amount of transfer bias current is selected dependently on: the detected size and thickness of the sheet 3; and the measured generated voltage amount. The transfer bias applying power supply 81 is controlled to apply the transfer roller 31 with the transfer bias current of the selected amount. Accordingly, even when the size or the thickness of the sheet 3 changes or even when the resistance of the transfer roller 31 changes, it is possible to continue applying the transfer roller 31 with an appropriate amount of transfer bias current that corresponds to the present size and the present thickness of the sheet 3 and to the present resistance of the transfer roller 31. It is therefore possible to attain high quality transfer operation through the constant current control even when the type of the recording medium changes or the environmental humidity changes.

22 Claims, 15 Drawing Sheets

SHEET WIDTH CORRESPONDENCE TABLE
(FOR NORMAL SHEETS MEASUREMENT CURRENT: −10 μA) UNIT: μA

| GENERATED VOLTAGE \ SHEET WIDTH | WIDTH 216mm~191mm | WIDTH 190mm~161mm | WIDTH 160mm~131mm | WIDTH 130mm~101mm | WIDTH 100mm~70mm |
|---|---|---|---|---|---|
| 0 kV | −30 | −30 | −30 | −30 | −30 |
| −0.1 kV | −30 | | | | |
| −0.2 kV | | | | | |
| −0.3 kV | | −30 | | | |
| −0.4 kV | | | −30 | | |
| −0.5 kV | | | | −30 | |
| −0.6 kV | | | | | −30 |
| −0.7 kV | | | | | |
| −0.8 kV | | | | | |
| −0.9 kV | | | | | |
| −1 kV | −18 | −20 | −22 | −24 | −26 |
| −3 kV | −14 | −14.75 | −15.5 | −16.25 | −17 |
| −5 kV | −12 | −12.5 | −13 | −13.5 | −14 |
| −7 kV | −10 | −10.5 | −11 | −11.5 | −12 |
| −8 kV | −10 | −10.5 | −11 | −11.5 | −12 |

SHEET WIDTH CORRESPONDENCE TABLE (FOR THICK SHEETS MEASUREMENT CURRENT: −10 μA) UNIT: μA

| GENERATED VOLTAGE \ SHEET WIDTH | WIDTH 216mm~191mm | WIDTH 190mm~161mm | WIDTH 160mm~131mm | WIDTH 130mm~101mm | WIDTH 100mm~70mm |
|---|---|---|---|---|---|
| 0 kV | −30 | −30 | −30 | −30 | −30 |
| −0.1 kV | −30 | | | | |
| −0.2 kV | | | | | |
| −0.3 kV | | −30 | | | |
| −0.4 kV | | | | | |
| −0.5 kV | | | −30 | | |
| −0.6 kV | | | | | |
| −0.7 kV | | | | −30 | |
| −0.8 kV | | | | | |
| −0.9 kV | | | | | |
| −1 kV | −18 | −21 | −24 | −27 | −30 |
| −3 kV | −15 | −16.25 | −17.5 | −18.75 | −20 |
| −5 kV | −14 | −14.5 | −15 | −15.5 | −16 |
| −8 kV | −14 | −14.5 | −15 | −15.5 | −16 |

SHEET WIDTH CORRESPONDENCE TABLE
(FOR EXTRA THICK SHEETS MEASUREMENT CURRENT: −10 μA) UNIT: μA

| GENERATED VOLTAGE \ SHEET WIDTH | WIDTH 216mm~191mm | WIDTH 190mm~161mm | WIDTH 160mm~131mm | WIDTH 130mm~101mm | WIDTH 100mm~70mm |
|---|---|---|---|---|---|
| 0 kV | −30 | −30 | −30 | −30 | −30 |
| −0.1 kV | −30 | | | | |
| −0.2 kV | | | | | |
| −0.3 kV | | −30 | | | |
| −0.4 kV | | | | | |
| −0.5 kV | | | −30 | | |
| −0.6 kV | | | | | |
| −0.7 kV | | | | | |
| −0.8 kV | | | | | |
| −0.9 kV | | | | −30 | |
| −1 kV | −18 | −21 | −24 | −27 | −30 |
| −3 kV | −15 | −17.5 | −20 | −22.5 | −25 |
| −5 kV | −14 | −15 | −16 | −17 | −18 |
| −8 kV | −14 | −15 | −16 | −17 | −18 |

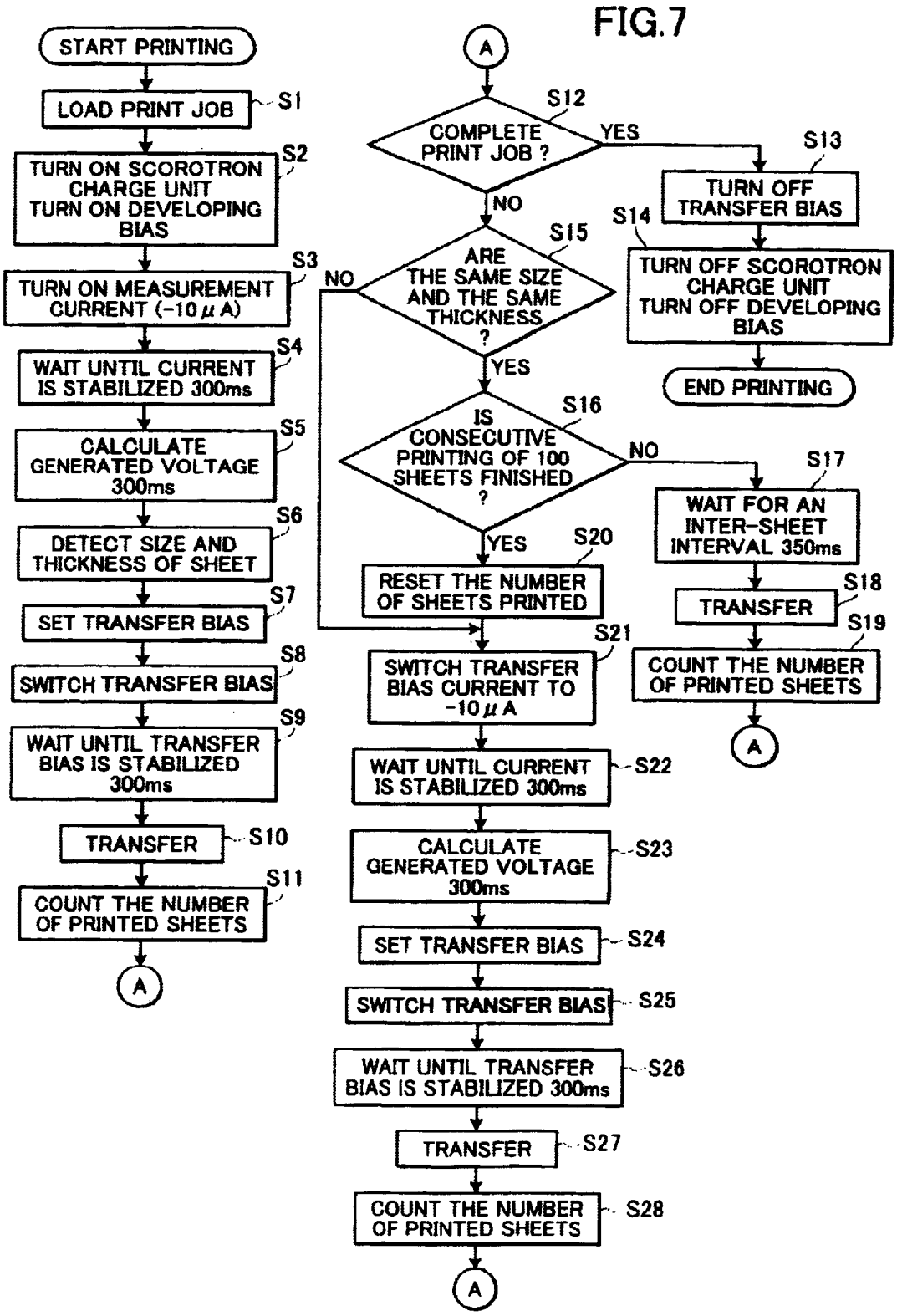
FIG.7
START PRINTING
LOAD PRINT JOB
S1
TURN ON SCOROTRON CHARGE UNIT TURN ON DEVELOPING BIAS
S2
TURN ON MEASUREMENT CURRENT (-10 μA)
S3
WAIT UNTIL CURRENT IS STABILIZED 300ms
S4
CALCULATE GENERATED VOLTAGE 300ms
S5
DETECT SIZE AND THICKNESS OF SHEET
S6
SET TRANSFER BIAS
S7
SWITCH TRANSFER BIAS
S8
WAIT UNTIL TRANSFER BIAS IS STABILIZED 300ms
S9
TRANSFER
S10
COUNT THE NUMBER OF PRINTED SHEETS
S11
A
A
COMPLETE PRINT JOB ?
S12
YES
NO
TURN OFF TRANSFER BIAS
S13
TURN OFF SCOROTRON CHARGE UNIT TURN OFF DEVELOPING BIAS
S14
END PRINTING
ARE THE SAME SIZE AND THE SAME THICKNESS ?
S15
NO
YES
IS CONSECUTIVE PRINTING OF 100 SHEETS FINISHED ?
S16
NO
YES
WAIT FOR AN INTER-SHEET INTERVAL 350ms
S17
TRANSFER
S18
COUNT THE NUMBER OF PRINTED SHEETS
S19
A
RESET THE NUMBER OF SHEETS PRINTED
S20
SWITCH TRANSFER BIAS CURRENT TO -10 μA
S21
WAIT UNTIL CURRENT IS STABILIZED 300ms
S22
CALCULATE GENERATED VOLTAGE 300ms
S23
SET TRANSFER BIAS
S24
SWITCH TRANSFER BIAS
S25
WAIT UNTIL TRANSFER BIAS IS STABILIZED 300ms
S26
TRANSFER
S27
COUNT THE NUMBER OF PRINTED SHEETS
S28
A

| MEASUREMENT CURRENT CORRESPONDENCE TABLE (FOR NORMAL SHEETS SHEET WIDTH: 100~70mm) | | | | | UNIT: μA |
|---|---|---|---|---|---|
| MEASUREMENT CURRENT / GENERATED VOLTAGE | -10μA≦X<-14μA | -14μA≦X<-18μA | -18μA≦X<-22μA | -22μA≦X<-26μA | -26μA≦X<-30μA |
| 0 kV | -30 | -30 | -30 | -30 | -30 |
| -0.1 kV | | | | | |
| -0.2 kV | | | | | |
| -0.3 kV | | | | | |
| -0.4 kV | | | | | |
| -0.5 kV | | | | | |
| -0.6 kV | -30 | | | | |
| -0.7 kV | | -30 | | | |
| -0.8 kV | | | -30 | | |
| -0.9 kV | | | | -30 | |
| -1 kV | -26 | -27 | -28 | -29 | -30 |
| -3 kV | -17 | -18 | -19 | -20 | -21 |
| -5 kV | -14 | -15 | -16 | -17 | -18 |
| -7 kV | -12 | -13 | -14 | -15 | -16 |
| -8 kV | -12 | -13 | -14 | -15 | -16 |

FIG.10(a)

MEASUREMENT CURRENT CORRESPONDENCE TABLE
(FOR NORMAL SHEETS SHEET WIDTH: 216～191mm)

UNIT: μA

| GENERATED VOLTAGE \ MEASUREMENT CURRENT | -10μA≦X<-12μA | -12μA≦X<-14μA | -14μA≦X<-16μA | -16μA≦X<-18μA | -18μA≦X<-20μA | -20μA≦X<-22μA | -22μA≦X<-24μA | -24μA≦X<-26μA | -26μA≦X<-28μA | -28μA≦X<-30μA |
|---|---|---|---|---|---|---|---|---|---|---|
| 0 kV | -30 | -30 | -30 | -30 | -30 | | | | | |
| -0.1 kV | -30 | | | | | | | | | |
| -0.2 kV | | -30 | | | | | | | | |
| -0.3 kV | | | -30 | | | | | | | |
| -0.4 kV | | | | -30 | | | | | | |
| -0.5 kV | | | | | -30 | | | | | |
| -0.6 kV | | | | | | -30 | | | | |
| -0.7 kV | | | | | | | -30 | | | |
| -0.8 kV | | | | | | | | -30 | | |
| -0.9 kV | | | | | | | | | -30 | |
| -1 kV | -18 | -19 | -20 | -21 | -22 | -23 | -24 | -26 | -28 | -30 |
| -3 kV | -14 | -15 | -16 | -17 | -18 | -19 | -20 | -22 | -24 | -26 |
| -5 kV | -12 | -13 | -14 | -15 | -16 | -17 | -18 | -20 | -22 | -24 |
| -7 kV | -10 | -11 | -12 | -13 | -14 | -15 | -16 | -18 | -20 | -22 |
| -8 kV | -10 | -11 | -12 | -13 | -14 | -15 | -16 | -18 | -20 | -22 |

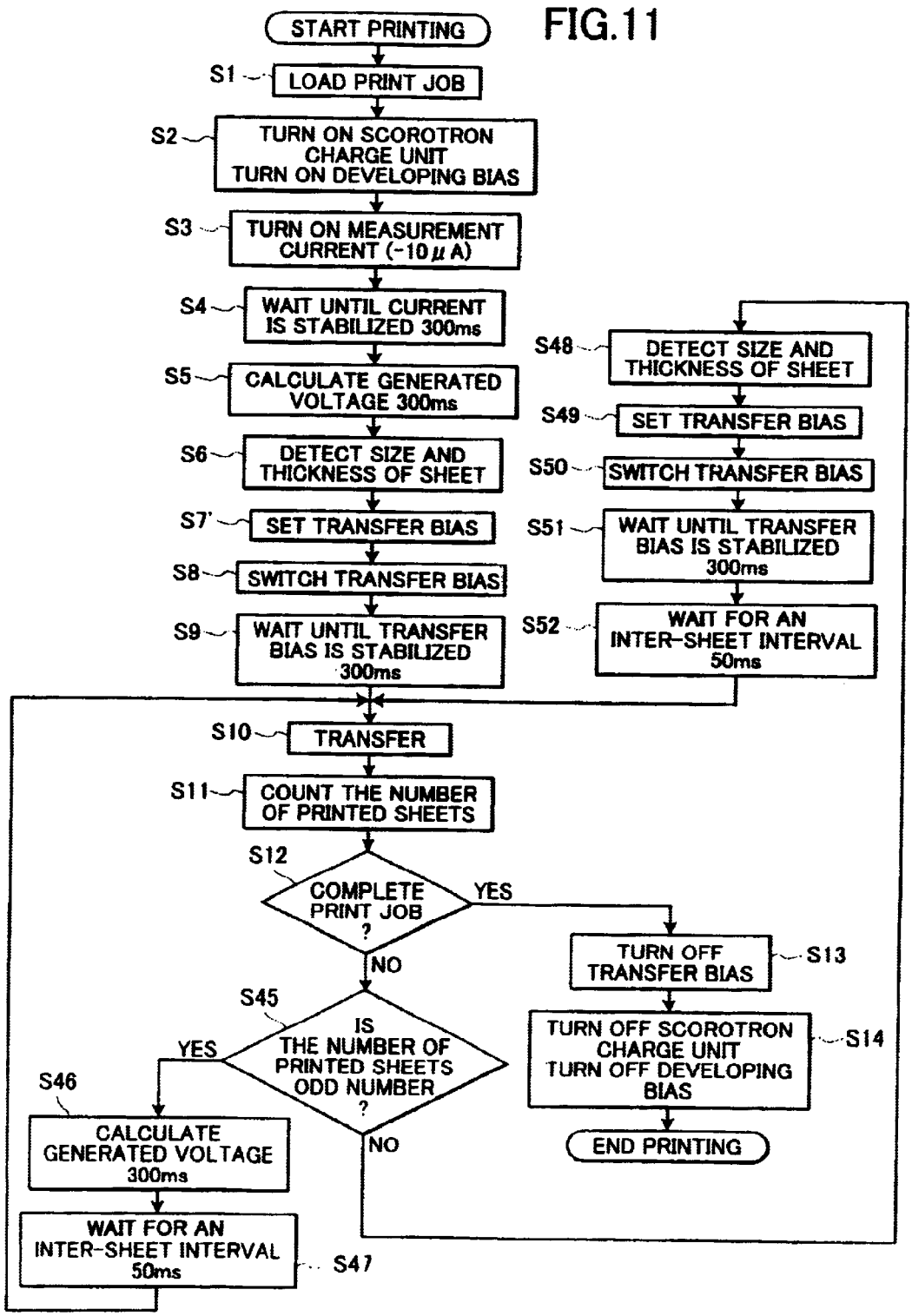
FIG.11
START PRINTING
S1
LOAD PRINT JOB
S2
TURN ON SCOROTRON CHARGE UNIT TURN ON DEVELOPING BIAS
S3
TURN ON MEASUREMENT CURRENT (-10 μA)
S4
WAIT UNTIL CURRENT IS STABILIZED 300ms
S5
CALCULATE GENERATED VOLTAGE 300ms
S6
DETECT SIZE AND THICKNESS OF SHEET
S7'
SET TRANSFER BIAS
S8
SWITCH TRANSFER BIAS
S9
WAIT UNTIL TRANSFER BIAS IS STABILIZED 300ms
S48
DETECT SIZE AND THICKNESS OF SHEET
S49
SET TRANSFER BIAS
S50
SWITCH TRANSFER BIAS
S51
WAIT UNTIL TRANSFER BIAS IS STABILIZED 300ms
S52
WAIT FOR AN INTER-SHEET INTERVAL 50ms
S10
TRANSFER
S11
COUNT THE NUMBER OF PRINTED SHEETS
S12
COMPLETE PRINT JOB ?
YES
NO
S13
TURN OFF TRANSFER BIAS
S14
TURN OFF SCOROTRON CHARGE UNIT TURN OFF DEVELOPING BIAS
END PRINTING
S45
IS THE NUMBER OF PRINTED SHEETS ODD NUMBER ?
YES
NO
S46
CALCULATE GENERATED VOLTAGE 300ms
WAIT FOR AN INTER-SHEET INTERVAL 50ms
S47

FIG.12

SHEET NUMBER CORRESPONDENCE TABLE (FOR NORMAL SHEETS SHEET WIDTH: 216～191mm) CURRENT VALUES TO BE ADDED (UNIT: μA)

| GENERATED VOLTAGE (GREATER THAN OR EQUAL TO ～ LESS THAN) \ TRIGGER SHEET NUMBER | 1 | 2 | 3 | 4 | 5 | 7 | 10 | 20 | 30 | 50 | 100 |
|---|---|---|---|---|---|---|---|---|---|---|---|
| -1～-2 kV | | | | | | | | | | | -0.1 |
| -2～-3 kV | | | | | | | -0.1 | | | -0.1 | -0.1 |
| -3～-4 kV | | | | | -0.1 | | -0.1 | -0.1 | -0.1 | -0.1 | -0.1 |
| -4～-5kV | -0.1 | -0.1 | -0.1 | -0.1 | -0.1 | -0.1 | -0.1 | -0.1 | -0.1 | -0.1 | -0.1 |
| -5～-6 kV | -0.3 | -0.2 | -0.2 | -0.2 | -0.2 | -0.2 | -0.2 | -0.1 | -0.1 | -0.1 | -0.1 |
| -6～-7 kV | -0.5 | -0.5 | -0.5 | -0.3 | -0.2 | -0.2 | -0.2 | -0.1 | -0.1 | -0.1 | -0.1 |
| -7～-8 kV | -0.5 | -0.5 | -0.5 | -0.5 | -0.5 | -0.3 | -0.3 | -0.2 | -0.2 | -0.1 | -0.1 |
| -8～-9 kV | -0.5 | -0.5 | -0.5 | -0.5 | -0.5 | -0.5 | -0.5 | -0.5 | -0.3 | -0.2 | -0.1 |

TRANSFER CONTROL FOR AN IMAGE FORMING APPARATUS

BACKGROUND OF THE INVENTION

1. Field of the Invention

The present invention relates to an image forming apparatus such as a laser printer.

2. Description of Related Art

A conventional image forming device, such as a laser printer, includes a photosensitive drum. A charge unit, a scanner, a developing roller, and a transfer roller are provided in this order around the photosensitive drum following the rotational direction of the photosensitive drum. As the photosensitive drum rotates, the following sequences of image forming processes are executed. That is, first, the surface of the photosensitive drum is entirely charged by the charge unit. Then, the surface of the photosensitive drum is exposed by a high speed scan of a laser beam from the scanner that is modulated by image data. As a result, an electrostatic latent image is formed on the photosensitive drum based on the image data. Next, as a result of rotation of the developing roller, toner borne on the surface of the developing roller is brought into contact with the photosensitive drum, and the toner on the developing roller is supplied to the electrostatic latent image on the photosensitive drum. As a result, toner is selectively borne on the photosensitive drum, thereby forming a visible toner image. Afterwards, the visible toner image borne on the surface of the photosensitive drum is transferred onto a sheet when the sheet passes between the photosensitive drum and the transfer roller.

Normally, in the image forming device of this type, the transfer roller is applied with a transfer bias in order to transfer the visible toner image onto a sheet. According to one conventional method, a transfer bias voltage of a fixed value is applied to the transfer roller. In this case, the value of the transfer bias voltage is controlled to be maintained to the fixed value by executing a constant voltage control operation. According to another conventional method, a transfer bias current of a fixed amount is applied to the transfer roller. In this case, the amount of the transfer bias current is controlled to be maintained to the fixed amount by executing a constant current control operation.

When a control is executed to apply a transfer bias voltage of a fixed value to the transfer roller, if the environmental humidity changes, the resistance value of the transfer roller also changes. This induces change in the amount of the current flowing through the transfer roller. For example, when the resistance value of the transfer roller increases to a too great value, the amount of the transfer current decreases to a too small amount. This will cause transfer problems.

On the other hand, when a control is executed to apply a transfer bias current of a fixed amount to the transfer roller, even if the environmental humidity changes and therefore the resistance value of the transfer roller changes, the fixed amount of current continues flowing through the transfer roller. Accordingly, it is desirable to apply the transfer bias current of a fixed amount to the transfer roller by executing the constant current control.

When the control is executed to apply the transfer bias current of a fixed amount to the transfer roller, however, if a sheet whose width is narrower than that of the transfer roller, is transported to the transfer roller, no part of the sheet exists between the photosensitive drum and the transfer roller at their axial ends. Accordingly, the transfer roller and the photosensitive drum directly contact with each other at their axial ends. A large amount of transfer current flows into the photosensitive drum directly from the transfer roller at those areas where the transfer roller directly contacts the photosensitive drum. This will decrease the amount of the transfer current that can appropriately flow through the sheet to transfer a visible toner image onto the sheet. This will cause transfer problems.

In order to solve this problem, Japanese Patent Application Publication No. 2-272590 has proposed to change the amount of the transfer bias current in accordance with change in the width of a sheet.

SUMMARY OF THE INVENTION

Even if the transfer bias current amount is changed dependently on the width of a sheet, however, transfer problems will still occur when the resistance value of the transfer roller changes according to change in the environment humidity.

For example, if the environment humidity becomes extremely high, the resistance value of the transfer roller will decrease. Accordingly, the proportion of the transfer current that flows into the photosensitive drum directly from the transfer roller will increase, and the amount of the transfer current that flows through the sheet will decrease. This will generate transfer problems. It is therefore conceivable to set the amount of the transfer current as being fixed to a large value in order to prevent this problem from occurring even if the environment humidity increases. However, in such a case, if the environmental humidity decreases, the resistance value of the transfer roller will increase, and the voltage generated through the transfer roller will increase. This will generate an electric discharge, and will occur transfer problems.

In view of the above-described drawbacks, it is an objective of the present invention to provide an improved image forming apparatus that is capable of attaining an appropriate transfer operation by executing a constant current control even when the type of recording media or the environmental humidity changes.

In order to attain the above and other objects, the present invention provides an image forming apparatus, comprising: an image bearing unit bearing a developing agent image thereon; a transfer unit transferring, at a transfer position, the developing agent image from the image bearing unit to a recording medium; a bias applying unit capable of applying a transfer bias current to the transfer unit while maintaining fixed the amount of the transfer bias current; a measuring unit measuring a resistance of the transfer unit; a type detecting unit detecting a type of the recording medium; and a control unit determining the amount of the transfer bias current, based on the detected recording medium type and on the measured resistance value, the control unit controlling the bias applying unit to apply the determined transfer bias current to the transfer unit.

BRIEF DESCRIPTION OF THE DRAWINGS

The above and other objects, features and advantages of the invention will become more apparent from reading the following description of the preferred embodiment taken in connection with the accompanying drawings in which:

FIG. 2(*b*) is a diagram illustrating how to measure the amount of voltage generated by a transfer roller provided in the laser printer of FIG. 1;

FIG. 3(*b*) is a graph plotting the values listed in the sheet-width correspondence table of FIG. 3(*a*);

FIG. 4(*b*) is a graph plotting the values listed in the sheet-width correspondence table of FIG. 4(*a*);

FIG. 5(*b*) is a graph plotting the values listed in the sheet-width correspondence table of FIG. 5(*a*);

FIG. 7 is a flowchart of the control process according to the embodiment;

FIG. 9(*b*) is a graph plotting the values listed in the measurement-current correspondence table of FIG. 9(*a*);

FIG. 20(*b*) is a graph plotting the values listed in the measurement-current correspondence table of FIG. 10(*a*);

FIG. 11 is a flowchart of the control process according to the second modification of the embodiment;

FIG. 12 is a sheet-number correspondence table for normal thick sheets with widths of 216–191 mm;

DETAILED DESCRIPTION OF THE PREFERRED EMBODIMENT

Figure 1:
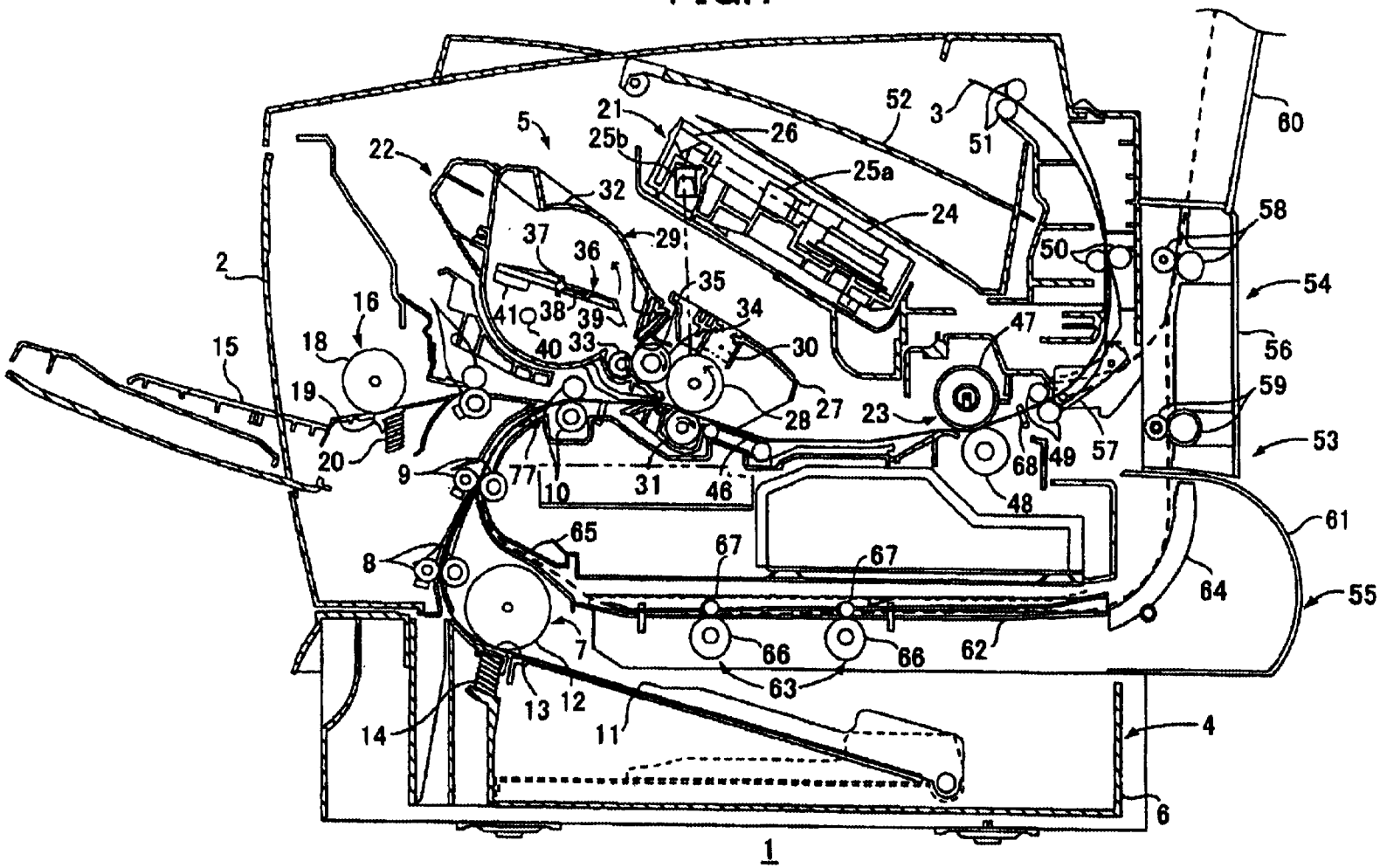
FIG. 1 is a cross-sectional view showing a cross section of a laser printer according to an embodiment of the present invention.

An image forming apparatus according to a preferred embodiment of the present invention will be described while referring to the accompanying drawings wherein like parts and components are designated by the same reference numerals to avoid duplicating description.

A laser printer 1 according to the present embodiment has a configuration shown in FIG. 1.

The laser printer 1 is for forming images using an electrophotographic image forming technique by using a nonmagnetic, single-component toner. A feeder section 4 and an image forming section 5 are provided within a casing 2 of s the laser printer 1. The feeder section 4 is for supplying sheets 3 (recording media). The image forming section 5 is for forming desired images on the supplied sheets 3.

The feeder section 4 is located within the lower section of the casing 2, and includes: a sheet supply tray 6, a sheet feed mechanism 7, transport rollers 8, transport rollers 9, and registration rollers 10. The sheet supply tray 6 is detachably mounted to the casing 2. The sheet feed mechanism 7 is provided at one end of the sheet supply tray 6. The transport rollers 8 and transport rollers 9 are is provided at a position downstream from the sheet feed mechanism 7 with respect to a sheet transport direction, in which sheets 3 are transported. The registration rollers 10 are provided downstream from the transport rollers 8 and the transport rollers 9 in the sheet transport direction.

The sheet supply tray 6 has a box shape with the upper side open so that a stack of sheets 3 can be housed therein. The sheet supply tray 6 can be moved horizontally into and out from the lower section of the casing 2 so as to be detachable from the casing 2. In the sheet supply tray 6, a sheet pressing plate 11 is provided. The sheet pressing plate 11 is capable of supporting a stack of sheets 3 thereon. The sheet pressing plate 11 is pivotably supported at its end furthest from the sheet feed mechanism 7 so that the end of the sheet pressing plate 11 that is nearest to the sheet feed mechanism 7 can move vertically. Although not shown in the drawing, a spring for urging the sheet pressing plate 11 upward is provided to the rear surface of the sheet pressing plate 11. Therefore, the sheet pressing plate 11 pivots downward in accordance with increase in the amount of, stacked sheets 3 on the sheet pressing plate 11. At this time, the sheet pressing plate 11 pivots around the end of the sheet pressing plate 11 farthest from the sheet feed mechanism 7, downward against the urging force of the spring.

The sheet feed mechanism 7 is provided with a sheet is supply roller 12 and a separation pad 13. The separation pad 13 is disposed in confrontation with the supply roller 12. A spring 14 is disposed to the rear side of the separation pad 13. The spring 14 urges the pad 13 to press against the supply roller 12.

Urging force of the spring under the sheet pressing plate 11 presses the uppermost sheet 3 on the sheet pressing plate 11 toward the supply roller 12. Rotation of the supply roller 12 pinches the uppermost sheet 3 between the supply roller 12 and the separation pad 13. Then, cooperative operation between the supply roller 12 and the separation pad 13 separates one sheet 3 at a time from the stack and supplies the sheet 3 downstream in the sheet transport direction. The transport rollers 8 and the transport rollers 9 send the supplied sheets 3 to the registration rollers 10.

The registration rollers 10 include a pair of rollers. The registration rollers 10 send a sheet 3 to an image forming position at a predetermined timing with respect to a timing when a registration sensor 77 detects the leading edge of the sheet 3. This operation is controlled by a CPU 71 (FIG. 2(*a*)) to be described later. It is noted that the image forming position is a transfer position, where visible toner images (developing agent images) are transferred from a photosensitive drum 28 (to be described later) onto a sheet 3. In other words, the image forming position is the contact position where the photosensitive drum 28 and a transfer roller 31 contact each other.

The feeder section 4 of the laser printer 1 further includes a multipurpose tray 15, a multipurpose sheet supply mechanism 16, and multipurpose transport rollers 17. The multipurpose tray 15 can receive a stack of sheets 3 with any desired size. The multipurpose sheet supply mechanism 16 is for supplying sheets 3 that are stacked on the multipurpose tray 15.

The multipurpose sheet supply mechanism 16 includes a multipurpose sheet supply roller 18 and a multipurpose separation pad 19. The multipurpose separation pad 19 is disposed in confrontation with the multipurpose sheet supply roller 18. A spring 20 is disposed to the underside of the multipurpose separation pad 19. The urging force of the spring 20 presses the multipurpose separation pad 19 against the multipurpose sheet supply roller 18.

Rotation of the multipurpose sheet supply roller 18 pinches the uppermost sheet 3 of the stack on the multipurpose tray 15 between the multipurpose sheet supply roller 18 and the multipurpose separation pad 19. Then, cooperative operation between the multipurpose sheet supply roller 18 and the multipurpose separation pad 19 separates one sheet 3 at a time from the stack to supply. The supplied sheet 3 is sent to the registration rollers 10 by the multipurpose transport roller 17.

By using the sheet supply tray 6 and the multipurpose tray 15, it is possible to use sheets 3 with desired types (desired sizes (widths) and desired thickness) for printing operation. A user can change the type of sheets 3 for printing by simply replacing the sheets 3 already stacked in the tray 6 or 15 with different types of sheets 3.

The image forming section 5 includes: a scanner section 21, a process unit 22, and a fixing section 23.

The scanner section 21 is provided at the upper section of the casing 2 and is provided with a laser emitting section (not shown), a rotatingly driven polygon mirror 24, lenses 25*a* and 25*b*, and a reflection mirror 26. The laser emitting section emits a laser beam based on desired image data. As indicated by two-dot chain line, the laser beam passes through or is reflected by the polygon mirror 24, the lens 25*a*, the reflection mirror 26, and the lens 25*b* in this order so as to irradiate, in a high speed scanning operation, the surface of the photosensitive drum 28 of the process unit 22.

The process unit 22 is disposed below the scanner section 21. The process unit 22 is attachable to and detachable from the casing 2. The process unit 22 has a drum cartridge 27, within which the photosensitive drum 28, a scorotron charge unit 30, and a transfer roller 31 are mounted.

A developing cartridge 29 is attachable to and detachable from the drum cartridge 27. The developing cartridge 29 is provided with a toner hopper 32. The developing cartridge 29 further includes: a supply roller 33, a developing roller 34, and a layer thickness regulating blade 35, which are disposed to the side of the toner hopper 32.

The toner hopper 32 is filled with positively charged, non-magnetic, single-component toner as a developing agent. For the toner, polymer toner obtained as a result of copolymerizing monomers by following a well-known polymerization technique such as suspension polymerization is used. Examples of polymerizable monomers are styrene monomers such as styrene, and acrylic monomers such as acrylic acid, alkyl (C1–C4) acrylate, alkyle (C1–C4) metaacrylate. Such polymerized toner has substantially sphere shape, and possesses extremely desirable fluidity. Furthermore, a colorant such as carbon black, and wax are combined in such toner. An external agent such as silica is externally attached to the polymerized toner to enhance the fluidity. The average diameter of the particle is approximately between 6 to 10 $\mu$m.

An agitator 36 is provided in the toner hopper 32. The agitator 36 includes: a rotation shaft 37, an agitation blade 38, and a film 39. The rotation shaft 37 is rotatably supported at the center of the toner hopper 32. The agitation blade 38 is provided along the length of the rotation shaft 37. The film 39 is adhered to the free end of the agitation blade 38. When the agitator 36 rotates as indicated by an arrow (in the counterclockwise direction) of the rotation shaft 37, the agitation blade 38 makes a circular movement forward so that the film 39 scrapes up toner in the toner hopper 32 to transport the toner toward a supply roller 33 to be described below.

A cleaner 41 is provided to the rotation shaft 37 at an opposite side of the agitation blade 38. The cleaner 41 is for cleaning windows 40 that are disposed to the side walls of the toner hopper 32 and are used for detecting the remaining amount of toner.

The supply roller 33 is disposed to the side of the toner hopper 32 so as to be rotatable as indicated by an arrow (in the clockwise direction). The supply roller 33 includes a metal roller shaft covered with a roller formed from an electrically conductive urethane sponge material.

The developing roller 34 is disposed to the side of the supply roller 33 so as to be rotatable as indicated by an arrow (in the clockwise direction). The developing roller 34 includes a metal roller shaft covered with a roller formed from an electrically conductive resilient material. In more specific terms, the surface of the developing roller 34 is made from electrically conductive urethane rubber or silicone rubber including, for example, carbon particles. The surface of the roller portion is covered with a coat layer of silicone rubber or urethane rubber that contains fluorine. The developing roller 34 is applied with a predetermined developing bias with respect to the photosensitive drum 28.

The supply roller 33 is disposed in confrontation with the developing roller 34. The supply roller 33 is in contact to the developing roller 34 to a certain extent that the supply roller 33 is compressed against the developing roller 34.

A layer thickness regulating blade 35 is disposed above the supply roller 33 so as to be in confrontation with the developing roller 34 following the axial direction of the developing roller 34 in the positional orientation between the confronting position with the supply roller 33 with respect to the rotating direction of the developing roller 34 and the confronting position with the photosensitive drum 28 described later. The layer thickness regulating blade 35 includes a plate spring member and a pressing member. The plate spring member is attached to the developing cartridge 29. The pressing member is mounted at the tip of the plate spring member and is formed from silicone rubber with electrically insulating properties. The pressing member has a half-circle shape when viewed in cross section. The pressing member is pressed onto the surface of the developing roller 34 by resilient force of the plate spring member.

Toner fed through the toner hopper 32 is supplied to the developing roller 34 by rotation of the supply roller 33. At this time, the toner is charged to a positive charge by friction between the supply roller 33 and the developing roller 34. Next, as the developing roller 34 rotates, the toner supplied on the developing roller 34 enters between the developing roller 34 and the pressing member of the layer thickness regulating blade 35. Therefore, the toner is fully charged again and is borne on the developing roller 34 in a thin layer of fixed thickness.

The photosensitive drum 28 is disposed to the side of the developing roller 34 and is in confrontation with the developing roller 34. The photosensitive drum 28 is supported in the drum cartridge 27 so as to be rotatable as indicated by an arrow (in the counterclockwise direction). The photosensitive drum 28 includes a main body connected to ground and a surface portion formed from a photosensitive layer that is made from polycarbonate and that has a positively charging nature.

The scorotron charge unit 30 is disposed above the photosensitive drum 28 in confrontation with the photosensitive drum 28 and separated from the photosensitive drum 28 by a predetermined space so as not to touch each other. The scorotron charge unit 30 is supported in the drum cartridge 27. The scorotron charge unit 30 is a positive-charge scorotron type charge unit for generating a corona discharge from a charge wire made from, for example, tungsten, to form a positive-polarity charge uniformly on the surface of the photosensitive drum 28.

The scorotron charge unit 30 forms a positive charge uniformly on the surface of the photosensitive drum 28 as the photosensitive drum 28 rotates. Then, the surface of the photosensitive drum 28 is exposed by high speed scan of the laser beam from the scanner section 21. As a result, an electrostatic latent image is formed on the photosensitive drum 28 based on the image data.

Next, a reverse developing process is performed. That is, when the positively-charged toner borne on the surface of the developing toner 34 is brought into contacting confrontation with the photosensitive drum 28 by rotation of the developing roller 34, the toner on the developing roller 34 is supplied to the electrostatic latent image on the photosensitive drum 28. That is, the toner is supplied to the exposed area of positively charged surface of the photosensitive drum 28. The electric potential of the exposed area has been decreased by the laser beam exposure. As a result, the toner is selectively borne on the photosensitive drum 28 so that the electrostatic latent image is developed into a visible toner image.

The transfer roller 31 is disposed below the photosensitive drum 28 in confrontation with the photosensitive drum 28. The transfer roller 31 is supported in the drum cartridge 27 so as to be rotatable as indicated by an arrow (in the clockwise direction). The transfer roller 31 is an ionic conductive type transfer roller that is made from a metal roller shaft covered by a roller made of ionic conductive rubber material. At times of toner image transfer, a transfer bias current is applied to the transfer roller 31 by a transfer bias application power supply 81 to be described later (FIG. 2(*b*)).

As a result of rotation of the photosensitive drum 28, the visible toner image is brought into contact with a sheet 3 that has been transported by the registration rollers 10 after registration. As a result, the visible toner image (developing agent image) borne on the surface of the photosensitive drum 28 is transferred onto the sheet 3 as the sheet 3 passes between the photosensitive drum 28 and the transfer roller 31. The sheet 3 on which the visible toner image has been transferred is transported to the fixing section 23 by a transport belt 46.

The fixing section 23 is disposed to the side of and downstream from the process unit 22 in the sheet transport direction. The fixing section 23 includes a thermal roller 47, a pressing roller 48, and transport rollers 49. The thermal roller 47 is provided with a halogen lamp (heater) in a metal base pipe. The pressing roller 48 is disposed below the thermal roller 47 in confrontation with the thermal roller 47 so that the pressing roller 48 presses the thermal roller 47 from down below. The transport rollers 49 are disposed downstream from the thermal roller 47 and the pressing roller 48 with respect to the sheet transport direction.

The sheet 3 transported from the fixing section 23 is thermally fixed when the sheet passes between the thermal roller 47 and the pressing roller 48. Afterward, the transport rollers 49 transport the sheet to transport rollers 50 provided on the casing 2 and to discharge rollers 51 also provided on the casing 2.

The transport rollers 50 are disposed downstream from the transport rollers 49 in the sheet transporting direction. The discharge rollers 51 are positioned above a discharge tray 52. The sheet 3 transported by the transport rollers 49 are transported to the discharge rollers 51 by the transport rollers 50. Afterward, the sheet 3 is discharged onto a sheet discharge tray 52 by the discharge rollers 51.

The laser printer 1 uses the developing roller 34 to collect residual toner that remains on the surface of the photosensitive drum 28 after toner is transferred onto the sheet 3 via the transfer roller 31. In other words, the laser printer 1 uses a "cleanerless development method" to collect the residual toner. By using the cleanerless development method to collect residual toner, there is no need to provide a separate member, such as a blade, for removing the residual toner or an accumulation tank for the waste toner. Therefore, the configuration of the laser printer can be simplified.

The laser printer 1 is provided with a retransport unit 53 that allows forming images on both sides of sheets 3. The retransport unit 53 is formed from an inverting mechanism 54 and a retransport tray 55, which are formed integrally with each other. The inverting mechanism 54 is attached externally to the rear side of the casing 2. The retransport tray 55 is freely detachably mounted by insertion into the casing 2 from a position above the feeder section 4.

The inverting mechanism 54 is attached to the rear side of the casing 2, and includes a casing 56, inversion rollers 58, retransport rollers 59, and an inversion guide plate 60. The casing 56 has a substantially rectangular is shape when viewed in cross section. The inversion rollers 58 and the retransport rollers 59 are disposed in the casing 56. The inversion guide plate 60 protrudes upward from the upper portion of the casing 56.

A flapper 57 is provided downstream from the transport rollers 49. The flapper 57 is for selectively switching transport direction of sheets 3, which reach the inverting mechanism 54 by transport of the transport rollers 49 after being printed on one side. The flapper 57 switches the sheet transport direction between a direction toward transport rollers 50 as indicated by solid line and a direction toward the inversion rollers 58 as indicated by broken line. The flapper 57 is pivotably supported at the rear side of the casing 2 and is disposed downstream from and adjacent to the transport roller 49. By activating or deactivating a solenoid (not shown), the flapper 57 can be swung to enable selectively switching transport direction of sheets 3 that have been transported to the inverting mechanism 54 by the transport rollers 49 after being printed on one side between the direction (solid line) toward transport rollers 50 and the direction (broken line) toward the inversion rollers 58.

The inversion rollers 58 are disposed downstream from the flapper 57 in the upper portion of the casing 56. The inversion rollers 58 include a pair of rollers that can switch rotational direction between forward and reverse directions. The inversion rollers 58 first rotate in the forward direction to transport a sheet 3 toward the inversion guide plate 60 and then rotate in the reverse direction to transport the sheet 3 in the reverse direction.

The retransport rollers 59 are disposed downstream from the inversion rollers 58 at a position that is substantially directly beneath the inversion rollers 58 in the casing 56. The retransport rollers 59 include a pair of rollers. The retransport rollers 59 transport the sheet 3 that has been inverted by the inversion rollers 58 to the retransport tray 55.

The inversion guide plate 60 is formed from a plate-shaped member that extends upward from the upper end of the casing 56 and serves to guide sheets 3 that are transported upward by the inversion rollers 58.

When a sheet 3 is to be formed with images on both surfaces, first the flapper 57 is switched into the position for guiding the sheet 3 toward the inversion rollers 58. While in this condition, the inverting mechanism 54 receives a sheet 3 on which an image has been formed on one side. When the received sheet 3 is transported to the inversion rollers 58, then the inversion rollers 58 rotate forward with the sheet 3 sandwiched therebetween so that the sheet 3 is transported upward following the inversion guide plate 60. Forward rotation of the inversion rollers 58 stops when most of the sheet 3 is transported upward out from the casing 56 and only the rear side end is sandwiched between the inversion rollers 58. Next, the inversion rollers 58 rotate in reverse to transport the sheet 3, with its front and rear surfaces reversed, almost directly downward to the retransport rollers 59. It should be noted that a sheet passage sensor 68 is provided downstream from the fixing section 23. The timing at which rotation of the inversion rollers 58 is switched from forward to reverse is controlled to the time after a predetermined duration of time elapses from when the sheet passage sensor 68 detects the tailing edge of the sheet 3. Also, when transport of the sheet to the inversion rollers 58 is completed, the flapper 57 switches to its initial position, that is, to the position for sending sheets from the transport rollers 49 to the transport rollers 50.

The sheet 3 transported by the retransport rollers 59 with its front and rear surfaces being reversed in this manner is transported by the retransport rollers 59 to the retransport tray 55.

The retransport tray 55 includes a sheet supply portion 61, a tray 62, and oblique rollers 63. The sheet supply portion 61 supplies the sheets 3 from the inverting mechanism 54.

The sheet supply portion 61 is attached to the rear end of the casing 2 at a position below the inverting mechanism 54. The sheet supply portion 61 includes an arc-shaped sheet guide member 64. In the sheet supply portion 61, sheets 3 that have been transported substantially vertically from the retransport rollers 59 of the inverting mechanism 54 are guided by the sheet guide member 64 into substantially the horizontal direction and toward the tray 62.

The tray 62 is a substantially rectangular-shaped plate and is provided in a substantially horizontal posture at a position above the sheet supply tray 6. The upstream end of the tray 62 is a continuation of the sheet guide member 64. In order to guide the sheet 3 from the tray 62 to the transport rollers 9, the upstream end of a retransport pathway 65 is continuous with the downstream end of the tray 62 and the retransport pathway 65 is connected to a midway section of the sheet transport pathway.

Two sets of oblique rollers 63 are disposed along the transport path of sheets 3 on the tray 62 and separated by a predetermined space in the direction in which sheets 3 are transported. The oblique rollers 63 are for transporting sheets 3 while abutting the sheets 3 against a reference plate (not shown).

Each set of oblique rollers 63 includes an oblique drive roller 66 and an oblique follower roller 67. Each oblique roller 63 is disposed near the reference plate that is provided along one widthwise edge of the tray 62, although not shown in the drawings. Imaginary rotation axis of each oblique drive roller 66 extends in a direction that is substantially perpendicular to the direction of sheet 3 transport. Each oblique drive roller 66 is disposed in confrontation with the corresponding oblique follower roller 67 so that transported sheets 3 are sandwiched therebetween. Each oblique follower roller 67 is disposed so that its imaginary rotational axis extends at a slant from a direction substantially perpendicular to the transport direction of sheets 3 so that the transport direction of sheets 3 moves toward the reference plate (not shown).

Sheets 3 that are transported out from the sheet supply portion 61 to the tray 62 are transported by the oblique rollers 63 while by the oblique rollers 63 abut the widthwise edge of the sheet 3 against the reference plate. Then the sheets 3 are transported through the retransport pathway 65 and once again toward the image forming position in a condition with front and rear surfaces reversed. Then the rear surface of a sheet 3 that has been transported to the image forming position is brought into contacting confrontation with the photosensitive drum 28. A visible toner image is then transferred from the photosensitive drum 28 onto the rear surface of the sheet 3. Next, the fixing section 23 fixes the visible toner image onto the sheet 3 and the sheet, which has images formed on both of its surfaces, is discharged onto the discharge tray 52.

According to the present embodiment, the transfer roller 31 is an ionic conductive type, in which ion-conductive agent is added to the resilient roller body of the transfer roller 31. The ionic conductive type transfer roller 31 can transfer toner images from the photosensitive drum 28 onto sheets 3 while transporting the sheets 3 appropriately. Additionally, because ion-conductive agent is added to the resilient roller body of the transfer roller 31, the transfer roller 31 has substantially a uniform resistance on its entire surface. The transfer roller 31 can therefore attain a high quality transfer operation.

It is noted, however, that the resistance of the ionic conductive type transfer roller 31 changes according to change in the environmental humidity. According to the present embodiment, control is attained to detect the type (size and thickness) of sheets 3 and the resistance value of the transfer roller 31 in the middle of a consecutive printing process, during which a plurality of sheets are printed in succession. The amount of the transfer bias current to be applied to the transfer roller 31 is determined based on the detected resistance value and sheet type, and the amount of the transfer bias current is switched to the newly-determined amount. Accordingly, even when the resistance value of the transfer roller 31 or the sheet type changes in the middle of the consecutive printing operation, it is possible to maintain a high quality printing by appropriately adjusting the amount of the transfer bias current dependently on the change.

Figure 2A:
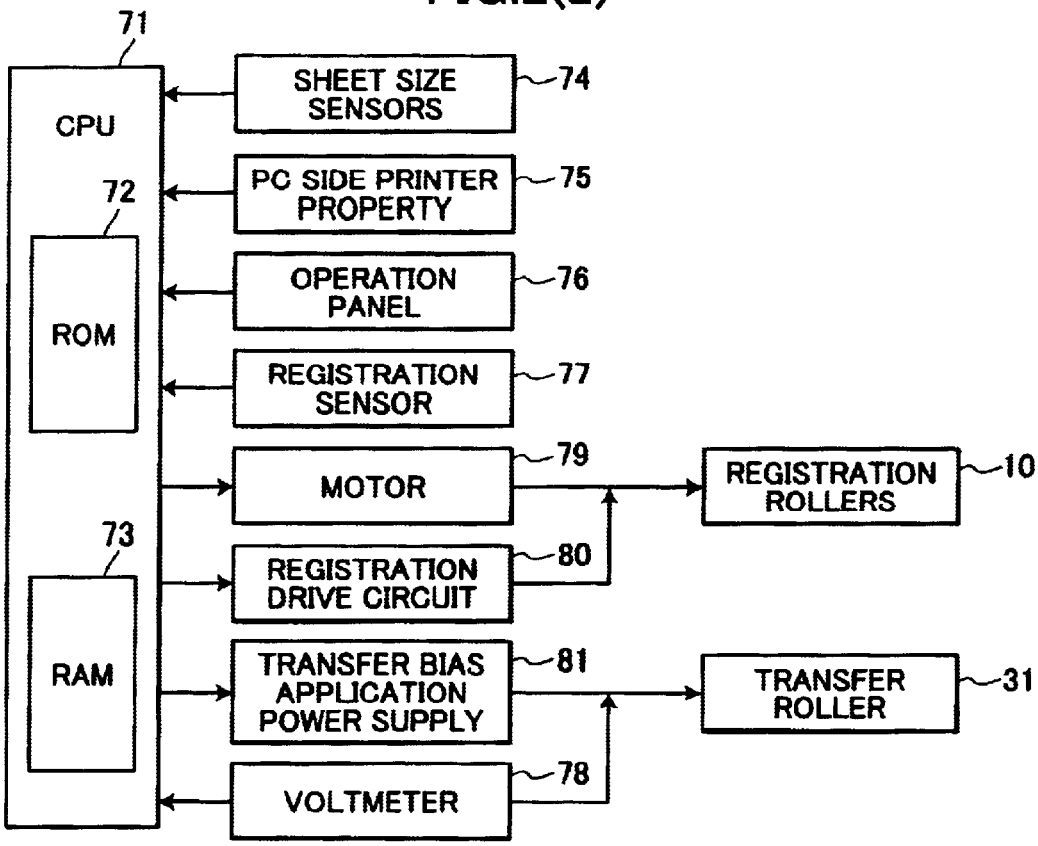
FIG. 2(*a*) is a block diagram showing a control portion of the laser printer of FIG. 1.
Figure 2B:
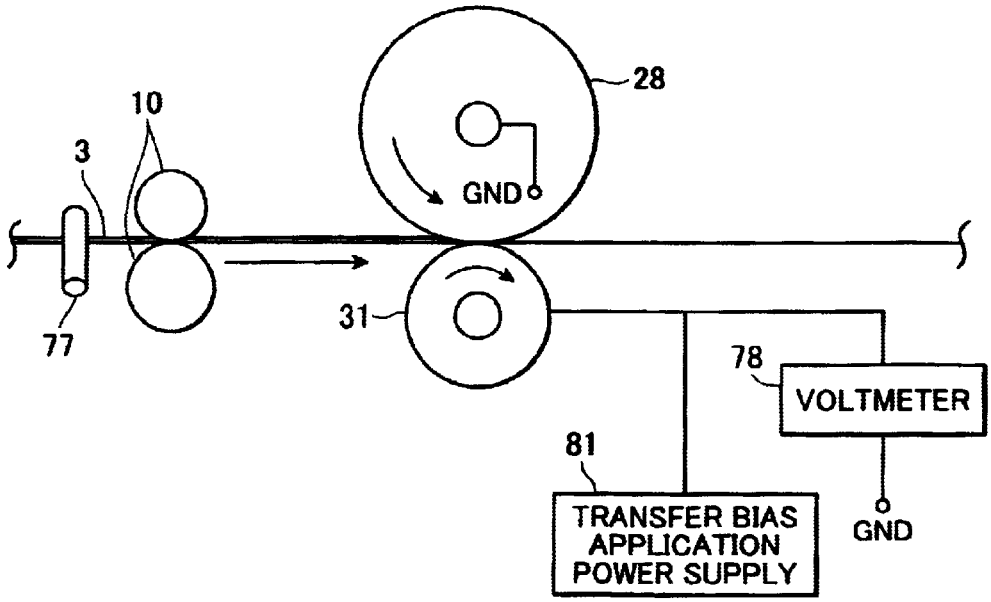

The above-describe later printer 1 has a control portion as shown in FIG. 2(*a*).

As shown in FIG. 2(*a*), a CPU 71 is connected to: sheet size sensors 74, a PC side printer property 75, an operation panel 76, a registration sensor 77, a motor 79, a registration drive circuit 80, a transfer bias application power supply 81, and a voltmeter 78.

The CPU 71 is provided with a ROM 72 and a RAM 73, and controls each section in the laser printer 1. The ROM 72 stores therein: control programs for controlling transfer bias application processes (FIG. 7) and image forming processes; and a sheet type detection program.

By executing the sheet type detection program, the CPU 71 detects the size and thickness of sheets 3 based on: data of the size and thickness of sheets 3 detected by the sheet size sensors 74; or data of the size and thickness of sheets 3 which is set through the PC side printer property 75 or the operation panel 76. It is noted that the size of sheets 3 is defined as a width of the sheets 3 along their directions perpendicular to the sheets transport direction.

The RAM 73 stores temporal numerical values supplied from: the sheet size sensors 74, the PC side printer property 75, the operation panel 76, the registration sensor 77, and the voltmeter 78. The numerical values are used for driving each section in the laser printer 1. The RAM 73 also stores numerical values measured by a timer and a counter to be described later.

Although not shown in FIG. 1, the sheet size sensor 74 is disposed inside each of the sheet supply tray 6 and the multipurpose tray 15 at its area for receiving sheets 3 therein. The sheet size sensor 74 detects the width (size) of sheets 3 set in the corresponding tray (the sheet supply tray 6 or the multipurpose tray 15), and supplies data of the detected size to the CPU 71.

The PC side printer property 75 is an interface established on a personal computer (PC) side with respect to the laser printer 1. The PC side printer property 75 enables an operator to set at the personal computer various settings for printing. By using the PC side printer property 75, the operator can input data of the size and thickness of sheets 3 into the CPU 71.

Although not shown in FIG. 1, the operation panel 76 is provided at the upper surface of the casing 2. Several keys are provided on the operation panel 76 so that the operator can input various settings for printing. The operator can manipulate the operation panel 76 to input data of the size and thickness of sheets 3 to the CPU 71.

The laser printer 1 can perform printing operation onto a plurality of different types of sheets 3. The CPU 71 classifies the plurality of types of sheets 3 into several (fifteen, in this example) categories with respect to the thickness and the width (size) of the sheets. More specifically, sheets 3 are classified depending on the thickness of the sheets 3 into three categories: normal sheets, thick sheets, and extra thick sheets. The sheets 3 are also classified depending on the width (size) of the sheets into five categories: sheet width in a range of 216–191 mm, sheet width in a range of 190–161 mm, sheet width in a range of 160–131 mm, sheet width in a range of 130–101 mm, and sheet width in a range of 100–70 mm.

The registration sensor 77 is disposed upstream from the registration rollers 10 and near to the registration rollers 10 as shown in FIG. 1. The registration sensor 77 is turned ON when the registration sensor 77 detects the arrival of the leading edge of a sheet 3. The registration sensor 77 is turned OFF when the registration sensor 77 detects that the trailing edge of the sheet 3 has passed by the registration sensor 77. The registration sensor 77 suplies the on/off detection signal to the CPU 71.

Based on the input of on/off detection signal from the registration sensor 77, the CPU 71 detects a jam of a sheet 3, detects the present position of the leading edge of a sheet 3, sets the length of an inter-sheet interval between successive transferring operations, and counts the number of sheets 3 printed.

The motor 79 is for driving the respective sections in the laser printer 1, including the registration rollers 10. The registration drive circuit 80 is for transmitting power of the motor 79 to the registration rollers 10, and for stopping transmitting the power to the registration rollers 10. The CPU 71 controls the registration drive circuit 80 to rotate the registration rollers 10 and to stop rotating the registration rollers 10.

As shown in FIG. 2(*b*), the transfer bias application power supply 81 is electrically connected to the roller shaft of the transfer roller 31. The CPU 71 controls the transfer bias application power supply 81 to apply the transfer roller 31 with a transfer bias current while maintaining fixed the amount of the transfer bias current by executing a constant current control until the CPU 71 switches the amount of the transfer bias current into a newly-updated amount.

It is noted that the polarity of an electric current is defined as being positive when the electric current flows in a direction from the transfer roller 31 toward the photosensitive drum 28. According to the present embodiment, during the transfer process, the transfer bias current flows from the photosensitive drum 28 to the transfer roller 31 and then to the transfer bias application power supply 81. Accordingly, the polarity of the transfer bias current is negative.

The voltmeter 78 is electrically connected to a circuit which is connected between the transfer bias application power supply 81 and the transfer roller 31. The CPU 71 controls the voltmeter 78 to measure the amount of voltage that is generated when the transfer bias application power supply 81 applies the transfer roller 31 with a measurement current of a predetermined amount (−10 $\mu$A (micro-ampere), in this example). The CPU 71 controls the transfer bias application power supply 81 to apply the transfer roller 31 with the measurement current. The voltmeter 78 supplies the CPU 71 with data of the measured voltage value.

According to the present embodiment, during the measuring process, the measurement current flows from the photosensitive drum 28 to the transfer roller 31 and then to the transfer bias application power supply 81. Accordingly, the polarity of the measuring current is negative, and the polarity of the voltage measured by the voltmeter 78 is negative.

It is noted that the voltmeter 78 is configured to measure the amount of the voltage thirty-two (32) times while the transfer roller 31 is executing one rotation. It is noted that it takes a predetermined period of time (300 msec, in this example) by the transfer roller 31 to rotate by 360 degrees (one rotation). The one-rotation period of 300 msec is divided into 32 sectional periods. The CPU 71 controls the voltmeter 78 to measure the voltage during each of the 32 sectional periods. Accordingly, the voltmeter 78 measures the voltage 32 times while the transfer roller 31 is rotating one rotation, and supplies data of the 32 number of the measured voltage values to the CPU 71.

The CPU 71 calculates the average of the 32 number of voltage values, and determines the value of the voltage, which is generated by the transfer roller 31 in response to application of the measurement current to the transfer roller 31. The thus determined voltage value data is indicative of the value of the resistance of the transfer roller 31. The CPU 71 uses this voltage value data as a parameter for determining the amount of the transfer bias current to be applied to the transfer roller 31.

Figures 3A, 3B:
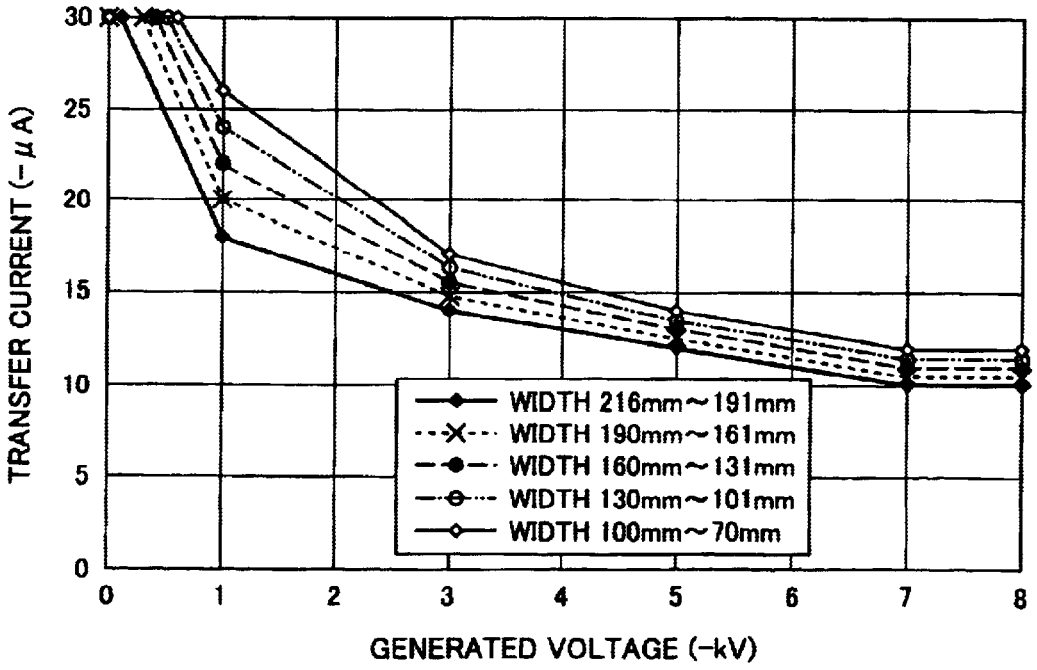
FIG. 3(*a*) is a sheet-width correspondence table for normal sheets.

More specifically, the ROM 72 stores therein three sheet-width correspondence tables (resistance/bias tables) of FIGS. 3(*a*), 4(*a*), and 5(*a*) in correspondence with the three different-thick sheets (normal sheets (normal-thickness sheets), thick sheets, and extra thick sheets). Each sheet-width correspondence table has five columns (five subsidiary tables) in correspondence with the five different widths (sizes) of sheets 3. In each table, each column lists up a plurality of transfer bias current values in correspondence with a plurality of voltage values. The plurality of voltage values are those values that will possibly be generated by the transfer roller 31 and will be measured by the voltmeter 78 when the transfer bias application power supply 81 applies the transfer roller 31 with a measuring current of the predetermined amount (−10 $\mu$A, in this example). Each transfer bias current value, on the table, is an appropriate value which should be applied to the transfer roller 31 in order to perform appropriate transfer operation onto a sheet 3 of a corresponding thickness and a corresponding width when the transfer roller 31 generates the corresponding amount of voltage in response to the application of the measuring current (−10 μA).

Figures 4A, 4B:
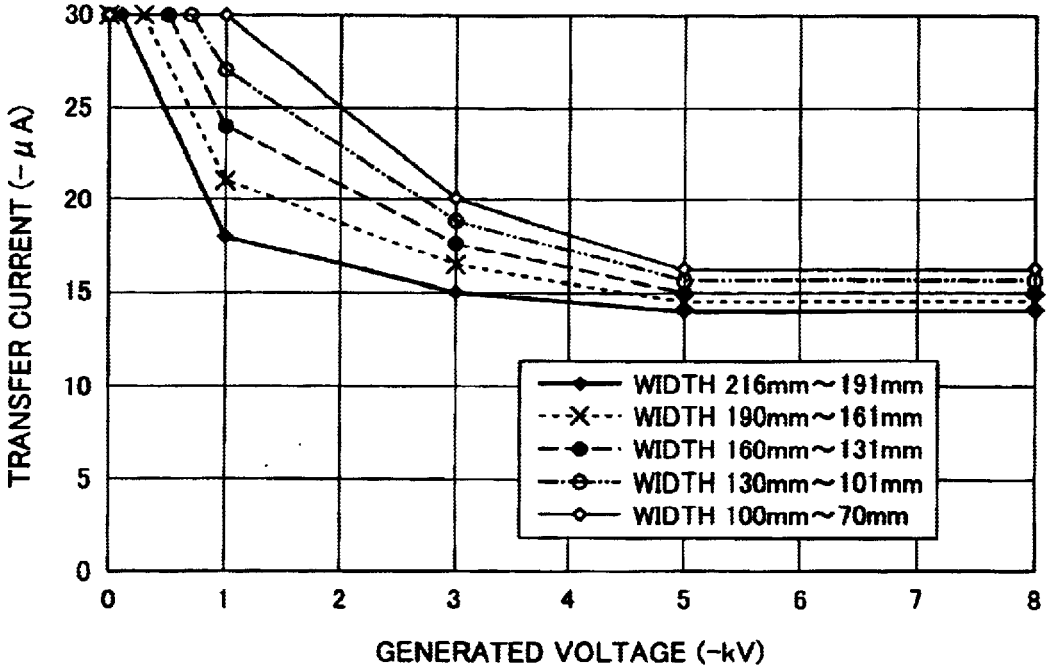
FIG. 4(*a*) is a sheet-width correspondence table for thick sheets.
Figures 5A, 5B:
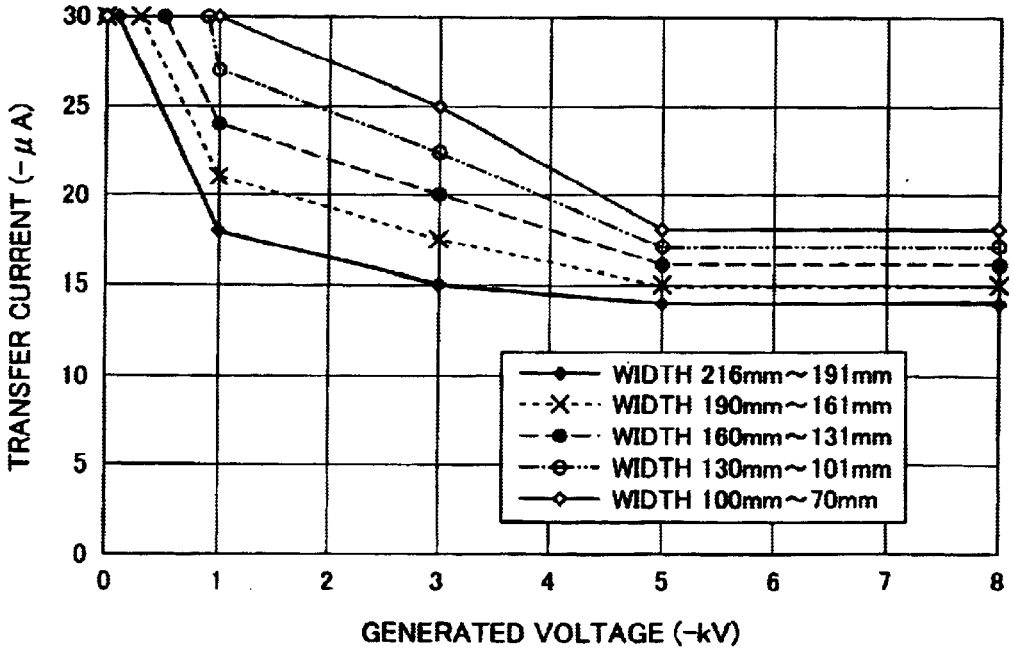
FIG. 5(*a*) is a sheet-width correspondence table for extra thick sheets.

It is noted that the tables of FIGS. 3(*a*), 4(*a*), and 5(*a*) list up, for all the fifteen voltage values of 0 kV (kilo-volt), −0.1 kV, −0.2 kv, . . . , −7 kv, and −8 kV, the transfer bias current values that are plotted on graphs of FIGS. 3(*b*), 4(*b*), and 5(*b*), respectively, although some table cells are left blank in the tables of FIGS. 3(*a*), 4(*a*), and 5(*a*). That is, in the table of FIG. 3(*a*), a cell for each voltage in each column is listed with such a current value that is shown in the graph of FIG. 3(*b*) as indicated by a point that falls on a line of a corresponding sheet-width at a corresponding voltage amount position. Similarly, in the table of FIG. 4(*a*), a cell for each voltage in each column is listed with such a current value that is shown in the graph of FIG. 4(*b*) as indicated by a point that falls on a line of a corresponding sheet-width at a corresponding voltage amount position. Similarly, in the table of FIG. 5(*a*), a cell for each voltage in each column is listed with such a current value that is shown in the graph of FIG. 5(*b*) as indicated by a point that falls on a line of a corresponding sheet-width at a corresponding voltage amount position. For example, although current values are omitted from those cells that correspond with the voltages from −0.2 kV to −0.9 kV in the column for the sheet width 216–191 mm in FIG. 3(*a*), these current values are shown in FIG. 3(*b*) as indicated by those points that fall on the most leftside section (range of 0 kV to −1 kV) of a solid line with solid diamond plots.

It is now assumed that the transfer roller 31 generates voltage of −3 kilovolts (kV) in response to the application of the predetermined amount (−10 μA) of measuring current. In order to perform appropriate transfer operation onto normal sheets 3 with sheet width 190–161 mm, it is known from the table of FIG. 3(*a*) that the transfer bias application power supply 81 should apply the transfer roller 31 with a transfer bias current of −14.75 μA. In order to perform transfer operation onto thick sheets 3 with sheet width 190–161 mm, it is known from the table of FIG. 4(*a*) that the transfer bias application power supply 81 should apply the transfer roller 31 with a transfer bias current of −16.25 μA. In order to perform transfer operation onto extra thick sheets 3 with sheet width 190–161 mm, it is known from the table of FIG. 5(*a*) that the transfer bias application power supply 81 should apply the transfer roller 31 with a transfer bias current of −17.5 μA.

Although not shown in the drawings, the CPU 71 is provided with a timer that is for setting the length of an inter-sheet interval between successive sheet printings when the laser printer 1 executes consecutive printing operations onto a plurality of sheets P in sucession. It is noted that the inter-sheet interval is defined as a period after the trailing edge of a sheet 3, on which transfer operation has been completed, is transported away from the transfer position (the position defined between the photosensitive drum 28 and the transfer roller 31) and until the leading edge of the next sheet 3 reaches the transfer position. The timer starts measuring time every time when the trailing edge of the sheet 3, onto which the toner image has been transferred at the transfer position, passes by the registration sensor 77. Every time the timer reaches a predetermined time, the CPU 71 controls the registration drive circuit 80 to drive the registration rollers 10 to start transporting the next sheet 3 to the transfer position so that the time interval (inter-sheet interval) will be provided between when the latest-printed sheet 3 has departed from the transfer position and when the next sheet 3 reaches the transfer position. Normally, the length of the inter-sheet interval is set to 350 msec.

The CPU 71 is provided also with a counter (not shown in the drawings). The counter counts the total number of sheets printed while the printer 1 is executing the consecutive printing. For example, the counter accumulates the number of times that the registration sensor 77 is turned from ON to OFF, and stores data of the resultant number in the RAM 73.

According to the present embodiment, when the laser printer 1 prints images onto successive sheets 3 consecutively, every time after a predetermined number of sheets (100 sheets, in this example) are printed, the CPU 71 executes a voltage-measuring operation and a bias-current switching operation. That is, the CPU 71 controls the transfer bias application power supply 81 to apply the transfer roller 31 with a measurement current of −10 μA. Then, the CPU 71 controls the voltmeter 78 to measure the amount of voltage that the transfer roller 31 generates in response to the application of the measurement transfer bias current (−10 μA). The CPU 71 selects one table among the three tables of FIGS. 3(*a*), 4(*a*), and 5(*a*) based on the thickness of the sheets 3 being used. The CPU 71 then selects one column from the selected table based on the size (width) of the sheets 3. The CPU 71 then selects one transfer bias current value from the selected column based on the measured voltage amount.

Figure 6:
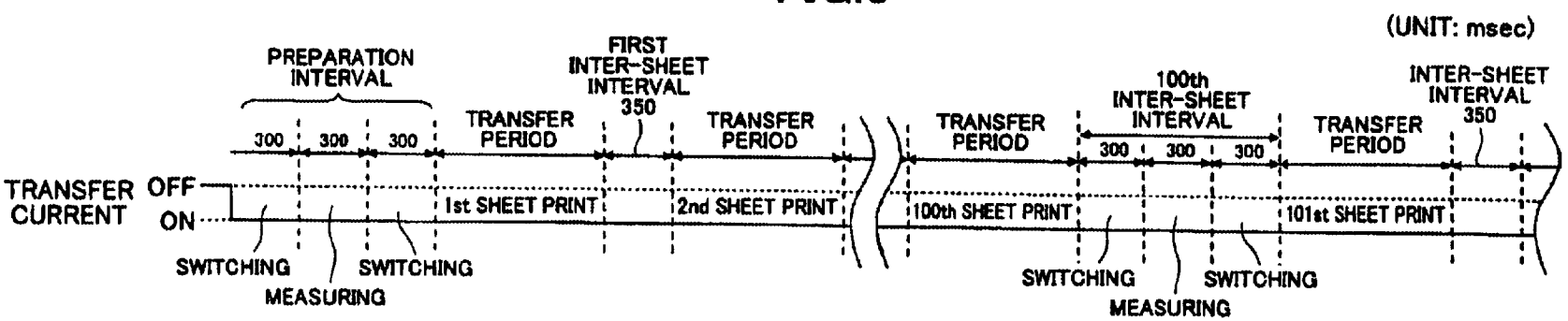
FIG. 6 is a timing chart of a control according to the embodiment.

The CPU 71 performs the voltage measuring operation and the transfer-bias current switching operation according to the control timings shown in FIG. 6.

When a printing process starts, the CPU 71 performs the voltage measuring operation and the transfer-bias current switching operation during a preparation interval (0-th inter-sheet interval) that is defined before the CPU 71 starts the transferring operation onto the first sheet 3.

That is, the transfer bias application power supply 81 starts applying the transfer roller 31 with the measurement current of −10 μA. Then, the CPV 71 waits for 300 msec so that the measurement current will become stable. Then, the voltmeter 78 measures the voltage 32 times while the transfer roller 31 rotates one rotation. The CPU 71 calculates the average of the 32 number of measurement results, thereby determining the amount of the voltage generated at the transfer roller 31. Based on the determined voltage amount, the CPU 71 selects a transfer bias from the sheet-width correspondence tables of FIGS. 3(*a*)–5(*a*). For example, if normal sheets 3 with sheet widths 190–161 mm are to be printed, and if the generated voltage amount is calculated as being equal to −3 kV, the CPU 71 selects the sheet-width correspondence table of FIG. 3(*a*), selects a column for sheet width 190–161 mm from the selected table of FIG. 3(*a*), and selects the transfer bias current value of −14.75 μA from the column of sheet width 190–161 mm in FIG. 3(*a*). The CPU 71 sets the selected value to be used for the first printing operation.

Next, the CPU 71 switches the transfer bias application power supply 81 to supply the newly-set value of transfer bias current to the transfer roller 31. As a result, the amount of the current supplied to the transfer roller 31 is switched from the measurement amount (−10 μA) into the newly-set value. The CPU 71 controls the transfer bias application power supply 81 to apply the transfer bias current of the newly-set value to the transfer roller 31.

The CPU 71 then waits for 300 msec so that the newly-applied transfer bias current will become satble. Thereafter, the CPU 71 starts executing a transfer process onto the first sheet 3. The CPU 71 executes the transfer process while controlling the amount of the transfer bias current to be fixed at the presently-set value.

Once transfer onto the first sheet 3 finishes, the CPU 71 waits during the inter-sheet interval of 350 msec. In this way, a first inter-sheet interval of 350 msec is provided after the first sheet transfer process. Thereafter, the CPU 71 executes transfer operation onto the next sheet 3 (second sheet), without changing the amount of the transfer bias current. The CPU 71 executes a transfer process onto the second sheet 3, while controlling the amount of the transfer bias current to be fixed at the presently-set value such consecutive printing continues until transfer onto the $100^{th}$ sheet is finished.

Once transfer onto the $100^{th}$ sheet 3 is finished, the CPU 71 again performs the voltage measuring operation and the transfer-bias switching operation in the same manner as when the CPU 71 performs those operations during the preparation interval (0-th inter-sheet interval) before starting the transfer process onto the first sheet. That is, the CPU 71 executes the voltage measuring operation and the transfer-bias switching operation during the $100^{th}$ inter-sheet interval that is provided immediately after the $100^{th}$ sheet transfer process.

More specifically, the CPU 71 controls the transfer bias application power supply 81 to switch the amount of the current to be supplied to the transfer roller 31 back to the predetermined measurement amount (−10 $\mu$A). The CPU 71 then for 300 msec so that the measurement current will become stable. Then, the CPU 71 controls the voltmeter 78 to measure 32 times the voltage generated by the transfer roller 31. The CPU 71 then calculates the average value of the 32 number of measured voltage values to determine the generated voltage value. The CPU 71 selects one transfer bias current value based on the determined voltage value by referring to the sheet-width correspondence tables of FIGS. 3(*a*)–5(*a*). Afterward, the CPU 71 switches the amount of the current from the measurement value (−10 $\mu$A) to the newly-set value, and controls the transfer bias application power supply 81 to start applying the newly-set amount of transfer bias current to the transfer roller 31. After waiting for approximately 300 msec until the transfer bias becomes stable, the CPU 71 starts transfer operation onto the 101st sheet 3.

It is noted that the CPU 71 controls the registration drive circuit 80 to provide the normal inter-sheet intervals of 350 msec after executing the transfer operations for the first through $99^{th}$ sheets, $101^{nd}$ through $199^{th}$ sheets, and so on. In other words, the CPU 71 sets, to 350 msec, the length of each of the first through $99^{th}$ inter-sheet intervals, the $101^{th}$ through $199^{th}$ inter-sheet intervals, and so on, which are respectively provided after the first through $99^{th}$ sheet transfer processes, the $101^{th}$ through $199^{th}$ sheet transfer processes, and so on.

Contrarily, the CPU 71 controls the registration drive circuit 80 to provide longer inter-sheet intervals of 900 msec before the transfer operation for the first sheet, and after the transfer operations for the 100th sheet, 200th sheet, and so on. In other words, the CPU 71 sets, to 900 msec, the length of each of the preparation interval (0-th inter-sheet interval), the $100^{th}$ inter-sheet interval, the $200^{th}$ inter-sheet interval, and so on, which are respectively provided before the first sheet transfer processes, the 101th sheet transfer process, the 201th sheet transfer process, and so on. During each of the 0-th, 100-th, 200-th, . . . inter-sheet intervals, in order to perform the voltage measuring operation and the transfer bias current switching operation, it is necessary to first switch the current amount into the predetermined measurement amount (−10 $\mu$A), then to measure the voltage, and then to switch the current amount to an amount that is newly determined based on the measurement result. Accordingly, the CPU 71 has to wait for a period of 300 msec until the newly-switched measuring current becomes stable, has to measure the voltage for another period of 300 msec, and has to further wait for another period of 300 msec until the newly-switched transfer bias current becomes stable. Accordingly, it takes a total of 900 msec to execute the voltage measuring operation and the transfer bias current switching operation.

In this way, according to the present embodiment, when the consecutive printing process starts, before executing the transfer process onto the first sheet, the CPU 71 provides the preparation interval (0-th inter-sheet interval) of 900 msec, during which the CPU 71 executes both of the voltage measuring operation and the transfer bias current switching operation.

Next, the CPU 71 executes the first sheet transfer process by applying the transfer roller 31 with the transfer bias current which has been set by the transfer bias current switching operation during the preparation interval (0-th inter-sheet interval), while maintaining the amount of the transfer bias current to be fixed to the set value.

When the first sheet transfer process is finished, the CPU 71 provides a first inter-sheet interval of 350 msec, during which the CPU 71 executes no voltage measuring operation or no transfer bias current switching operation.

Next, the CPU 71 executes a transfer process onto the second sheet in the same manner as the first sheet transfer process, that is, by applying the transfer bias current which has been set by the transfer bias current switching operation during the preparation interval (0-th inter-sheet interval). When the second sheet transfer process is finished, the CPU 71 provides a second inter-sheet interval of 350 msec in the same manner as the first inter-sheet interval of 350 msec, during which the CPU 71 executes no voltage measuring operation or no transfer bias current switching operation.

In this way, the CPU 71 executes the first through $100^{th}$ sheet-transfer processes while providing the first through $99^{th}$ inter-sheet intervals of 350 msec in the same manner as described above.

When the 100-th sheet transfer process is finished, the CPU 71 provides a 100-th inter-sheet interval of 900 msec, during which the CPU 71 executes both of the voltage measuring operation and the transfer bias current switching operation in the same manner as in the preparation interval (0-th inter-sheet interval).

Next, the CPU 71 executes the transfer process for the 101st sheet by applying the transfer bias current which has been set by the transfer bias current switching operation during the $100^{th}$ inter-sheet interval and by maintaining fixed the amount of the transfer bias current.

When the 101st sheet transfer process is finished, the CPU 71 provides a 101st inter-sheet interval of 350 msec, during which the CPU 71 executes no voltage measuring operation or no transfer bias current switching operation.

In this way, the CPU 71 sets 900 msec to the length of each of the $0^{th}$, $100^{th}$, $200^{th}$, . . . , inter-sheet intervals, and executes both of the voltage measuring operation and the transfer bias current switching operation during each of the $0^{th}$, $100^{th}$, $200^{th}$, . . . inter-sheet intervals. The CPU 71 sets 350 msec to the length of each of the first through $99^{th}$, 101th through $199^{th}$, . . . inter-sheet intervals, and executes no voltage measuring operation or no transfer bias current switching operation during each of the first through $99^{th}$, 101th through $199^{th}$, . . . inter-sheet intervals. During the first through $100^{th}$ sheet transfer process, the CPU 71 executes the transfer process by applying the transfer bias current which has been set by the transfer bias current switching operation during the preparation interval (0-th inter-sheet interval). During the 101st through $200^{th}$ sheet transfer process, the CPU 71 executes the transfer process by applying the transfer bias current which has been set by the transfer bias current switching operation during the $100^{th}$ inter-sheet interval. In this way, during each sheet transfer process, the CPU 71 executes the transfer process by applying the transfer roller 31 with the transfer bias current, which has been set by the latest-executed transfer bias current switching process.

Thus, according to the present embodiment, during each of the $0^{th}$ and (a×100)-th inter-sheet interval (where "a" is an integer equal to or greater than one (1)), both of the voltage measuring process and the transfer bias current switching process are executed. Accordingly, the length of each of the $0^{th}$ and (a×100)-th inter-sheet intervals is set to 900 msec. In the voltage measuring process, the CPU 71 measures and determines the voltage generated by the transfer roller 31 in response to the application of the predetermined amount of current (−10 μA). In the transfer bias current switching process, the CPU 71 switches the transfer bias current amount into such an amount that is appropriate to the type of the sheets 3 and that corresponds to the generated voltage value, while referring to the sheet-width correspondence tables of FIGS. 3(*a*)–5(*a*).

During each i-th sheet transfer process (where i is an integer equal to or greater than one), the transfer process is executed onto the corresponding i-th sheet by applying the transfer roller 31 with the transfer bias current whose amount has been set by a transfer bias current switching process that has been executed latest.

During each inter-sheet interval other than the $0^{th}$ and (a×100)-th inter-sheet intervals, no voltage measuring process or no transfer bias current switching process is executed. The length of each inter-sheet interval other than the $0^{th}$ and (a×100)-th inter-sheet intervals is set to the normal length of 350 msec.

Next, this control process will be described in greater detail with referring to the flowchart of FIG. 7.

When a printing process starts, a printing job is loaded in S1.

Then, in S2, the scorotron charge unit 30 is turned ON, and a developing bias of the developing roller 34 is turned ON.

Then, in S3, the transfer bias application power supply 81 applies the predetermined amount of measurement current (−10 μA) to the transfer roller 31.

In S4, the CPU 71 waits for 300 msec until the applied measurement current becomes stable.

Then, in S5, the voltage is measured 32 times by the voltmeter 78, and the average of the measured voltage is calculated. In this way, the generated voltage amount is determined.

In S6, the size and the thickness of the sheets 3 are detected by executing the sheet type detection program and based on: the size information of the sheets 3 detected by the sheet size sensor 74 in the tray 6 or 15; the size and thickness information of the sheets 3 which is supplied from the PC side printer property 75 at a time when the printing job is loaded; or the size and thickness information of the sheets 3 that is entered from the operation panel 76.

Next, in S7, the CPU 71 selects one sheet-width correspondence table that corresponds to the detected thickness of the sheets 3 among the three sheet-width correspondence tables of FIGS. 3(*a*)–5(*a*). Also in S7, the CPU 71 selects one column that corresponds to the detected width of the sheets 3 from the selected sheet-width correspondence table. Also in S7, the CPU 71 selects, from the selected column, a current value that corresponds to the calculated voltage amount, and sets the selected current value as a transfer bias for the printing operation to be executed.

Then, in 58, the CPU 71 switches the amount of the transfer bias current from the measurement value (−10 μA) to the newly-set value. The CPU 71 controls the transfer bias application power supply 81 to start applying the newly-set transfer bias current to the transfer roller 31.

After waiting in S9 for 300 msec until the newly-set transfer bias becomes stable, the CPU 71 executes transfer onto one sheet 3 (first sheet at this time) in S10.

Then, in S11, the number of sheets 3 already printed consecutively is counted. The number (1) is counted at this time.

Next, it is judged in 512 whether or not the present printing job should end. If the present printing job should end (S12:yes), the transfer bias is turned off in S13. Then, in S14, the scorotron charge unit 30 is turned off, and the developing bias for the developing roller 34 is turned off. Then, the printing process ends.

On the other hand, if the printing job should continue (S12; no), it is judged in S15 whether or not the size and the thickness of the sheet 3 to be printed by the next transfer process are the same as those of the previously-printed sheet. If the size and the thickness of the next sheet 3 are the same as those of the previously-printed sheet (S15: yes), it is judged in S16 whether or not the total number of the consecutively-printed sheets 3 has reached 100. If the total number of the printed sheets has not yet reached 100 (S16: no), the CPU 71 waits for the normal inter-sheet interval of 350 msec in S17. Then, transfer onto the next sheet 3 is performed in S18, and the number of the consecutively-printed sheets is counted in S19

On the other hand, if the number of the consecutively-printed sheets reaches 100 (516: yes), the CPU 71 resets the counter in S20. In S21, the CPU 71 switches the amount of the transfer bias current back to the predetermined measurement amount (−10 μA). After the measurement current becomes stable in S22, in S23, the voltage generated by the transfer roller 31 is measured 32 times and the average of the measured voltages is calculated.

Then, in S24, an appropriate amount of transfer bias current is set in the same manner as in S7. In S25, the amount of the transfer bias current is switched into the newly-set amount, and the transfer bias application power supply 81 starts applying the newly-set amount of transfer bias current to the transfer roller 31 in the same manner as in S8. After waiting for 300 nm so that the newly-applied transfer bias current becomes stable in S26 in the same manner as in S9, transfer onto the next sheet 3 is executed in S27 in the same manner as in S30, and the number of printed sheets is counted in S28 in the same manner as in S11.

On the other hand, if the size or the thickness of the next sheet 3 is different from that of the previously printed sheet (S15: no), the program directly proceeds to S21 even when the number of the consecutively printed sheets has not yet reached 100. Then, the processes of S21–S28 are executed as described above.

As described above, according to the present embodiment, the transfer bias applying power supply 81 applies a transfer bias current of a fixed amount to the transfer roller 31 by executing a constant current control operation. The voltmeter 78 measures the amount of voltage generated by the transfer roller 31. The generated voltage amount indicates the resistance of the transfer roller 31. The sheet type detecting program is executed to detect the size and thickness of a sheet 3. An amount of transfer bias current is selected dependently on: the detected size and thickness of the sheet 3; and the measured generated voltage amount. The transfer bias applying power supply 81 is controlled to apply the transfer roller 31 with the transfer bias current of the selected amount. Accordingly, even when the size or the thickness of the sheet 3 changes or even when the resistance of the transfer roller 31 changes, it is possible to continue applying the transfer roller 31 with an appropriate amount of transfer bias current that corresponds to the present size and the present thickness of the sheet 3 and to the present resistance of the transfer roller 31. It is therefore possible to attain high quality transfer operation through the constant current control even when the type of the recording medium changes or the environmental humidity changes.

As described above, according to the present embodiment, a transfer bias is selected based on: the size and the thickness of sheets 3 detected by the sheet type detection program; and the generated voltage measured by the voltmeter 78. The selected transfer bias is applied from the transfer bias application power supply 81 to the transfer roller 31. Therefore, even if the size or the thickness of sheets 3 change and furthermore the resistance value of the transfer roller 31 changes, it is possible to attain an appropriate transfer operation by a constant current control by applying a transfer bias of an amount that corresponds to the generated voltage presently measured by the voltmeter 78 and that corresponds to the present size and thickness of the sheets 3.

The voltage generated by the transfer roller 31 is measured by the voltmeter 78 by the time when the first sheet 3 is subjected to a transferring process. Therefore, an optimal transfer bias can be applied to the transfer roller 31 during the transfer process onto the first sheet 3. It is possible to attain an ideal transfer operation from the beginning of the printing process.

The voltage generated by the transfer roller 31 is measured every time after the predetermined number of sheets (100 sheets) are printed. Therefore, even if the resistance value of the transfer roller 31 changes with the passage of time as the number of printed sheets increases, an optimal transfer bias can be applied to the transfer roller 31 by measuring the voltage generated by the transfer roller 31 every time after the predetermined number of sheets have been printed. It is possible to attain an ideal transfer during consecutive printing by applying the transfer roller 31 with a transfer bias that appropriately corresponds to the present resistance value of the transfer roller 31.

Even if the size or the thickness (type) of sheets 3 changes in the middle of the consecutive printing, an optimal transfer bias can be applied to the transfer roller 31 by measuring the amount of the voltage of the transfer roller 31 which changes dependently on the change in the size and thickness of the sheets 3. It is possible to apply an ideal transfer bias that appropriately corresponds to the changed size and thickness of sheets 3.

During the inter-sheet interval, the amount of the current is first switched to the predetermined measurement amount (−10 $\mu$A), and then both of the measuring operations and the transfer-bias switching operation are executed in this order. That is, first, the voltmeter 78 is controlled to measure the voltage generated by the transfer roller 31. Then, the amount of the transfer bias is switched from the measurement amount to an appropriate amount that is determined based on the measured result. Therefore, it is possible to determine the optimal amount of the transfer bias current and to switch the transfer bias current to the optimal amount during the single inter-sheet interval that is provided immediately before the transfer operation. It is possible to apply an appropriate transfer bias to the transfer roller 31 in a simplified and reliable manner.

Because both of the voltage measuring operation and the transfer-bias switching operation are executed in succession during the single inter-sheet interval, the length of the inter-sheet interval, during which the voltage measuring operation and the transfer-bias switching operation are executed, is set to 900 msec, which is longer than the length (350 msec) of the normal inter-sheet interval, during which the voltage measuring operation or the transfer-bias switching operation is not executed. Therefore, both of the measuring and the switching operation can be achieved reliably.

The ROM 72 stores therein fifteen sheet-width correspondence subsidiary tables (columns in FIGS. 3(*a*) 5(*a*)) in correspondence with the fifteen types of sheets 3, that is, fifteen combinations of size and thickness of the sheets 3. In each sheet-width correspondence subsidiary table, a plurality of transfer bias values are listed in correspondence with a plurality of amounts of voltages, which will possibly be generated by the transfer roller 31 in response to application of the measuring current of the predetermined amount (−10 $\mu$A). The CPU 71 selects, among the fifteen sheet-width correspondence subsidiary tables, one subsidiary table that corresponds to the size and thickness of sheets 3 to be printed. It is possible to select the amount of bias current that appropriately corresponds to the size and thickness of sheets 3 and to the resistance value of the transfer roller 31 by simply selecting, from the selected subsidiary table, one transfer bias current amount that corresponds to the presently-measured voltage generated by the transfer roller 31. It is possible to apply the transfer roller 31 with a transfer bias current that corresponds to the size and thickness of sheets 3 to be transferred and that corresponds to the measured amount of the voltage being generated presently. It is possible to attain an ideal transfer operation with a constant current control.

The transfer bias application power supply 81 applies the transfer roller 31 with the predetermined amount (−10 $\mu$A) of current as a measurement current. Therefore, the sheet-width correspondence tables are prepared only for the single amount (−10 $\mu$A) of the measurement current. This also simplifies the control.

The CPU 71 controls the transfer bias application power supply 81 to apply the measurement current to the transfer roller 31. The CPU 71 controls the voltmeter 78 to measure the amount of voltage generated by the transfer roller 31 in response to the application of the measurement current. The measured amount of the generated voltage is used as data indicative of the resistance value of the transfer roller 31. It is therefore possible to measure information indicative of the resistance of the transfer roller 31 in a simplified manner.

First Modification

In the above description, the voltage measuring operation and the transfer-bias current switching operation are executed every time after the predetermined number of sheets (100 sheets) have been printed. The predetermined number is not limited to 100 but can be set to any other desirable numbers. For example, the predetermined number can be set to one (1). In this case, the voltage measuring operation and the transfer-bias current switching operation are executed every time after one sheet has been printed. In other words, the voltage measuring operation and the transfer-bias current switching operation will be executed at every inter-sheet interval. In this case, the length of every inter-sheet interval is set to the value of 900 msec that is longer than the normal length of 350 msec.

Second Modification

In the above-described embodiment, the voltage measuring operation and the transfer-bias current switching operation are executed every time after the predetermined number of sheets (100 sheets) have been printed. Accordingly, the voltage measuring operation and the transfer-bias current switching operation are executed during only the preparation interval (0-th inter-sheet interval), the 100th inter-sheet interval, the 200th inter-sheet interval, and so on. During other remaining inter-sheet intervals (1st through 99th inter-sheet intervals, 101st through $199^{th}$ inter-sheet intervals, and so on), the voltage measuring operation or the transfer-bias current switching operation is not executed.

Contrarily, according to the present modification, either one of the voltage measuring operation and the transfer-bias current switching operation is executed during each inter-sheet interval except for the 0-th inter-sheet interval (preparation interval). The voltage measuring operation and the transfer-bias current switching operation are executed alternately through the successive series of inter-sheet intervals except for the 0-th inter-sheet interval. More specifically, during the preparation interval (0-th inter-sheet interval), both of the voltage measuring operation and the transfer-bias current switching operation are executed. However, only the voltage measuring operation is executed during the odd-number inter-sheet intervals that are provided immediately after the odd-number-th sheet printing operations. Only the transfer-bias current switching operation is executed during the even-number-th inter-sheet intervals that are provided immediately after the even-number-th sheet printing operations.

It is noted that during each odd-number inter-sheet interval that is provided immediately after its corresponding odd-number-th sheet printing operation, the measuring operation is executed by applying the transfer roller 31 with a measuring current whose amount is equal to that of the transfer bias current that has been applied to the transfer roller 31 during the corresponding odd-number-th sheet printing operation. For example, during the first inter-sheet interval that is provided immediately after the first sheet printing process, the measuring operation is executed by applying the transfer roller 31 with a measuring current whose amount is equal to that of the transfer bias current that has been applied to the transfer roller 31 during the first sheet printing process. Similarly, during the third inter-sheet interval that is provided immediately after the third sheet printing process, the measuring operation is executed by applying the transfer roller 31 with a measuring current whose amount is equal to that of the transfer bias current that has been applied to the transfer roller 31 during the third sheet printing process.

According to the present embodiment, the ROM 72 stores therein a plurality of measurement-current correspondence tables in correspondence with a plurality of types (thickness and size combinations) of sheets. In this example, the ROM 72 stores therein fifteen measurement-current correspondence tables in correspondence with the fifteen different types (fifteen thickness-and-size is combinations) of sheets. The fifteen different types are defined by the combinations of the three different thickness categories of "normal sheets", "thick sheets", and "extra thick sheets" and of the five different width categories of "216–191 mm", "190–161 mm", "160–131 mm", "130–101 mm", and "100–70 mm" in the same manner as in the above-described embodiment.

Figures 9A, 9B:
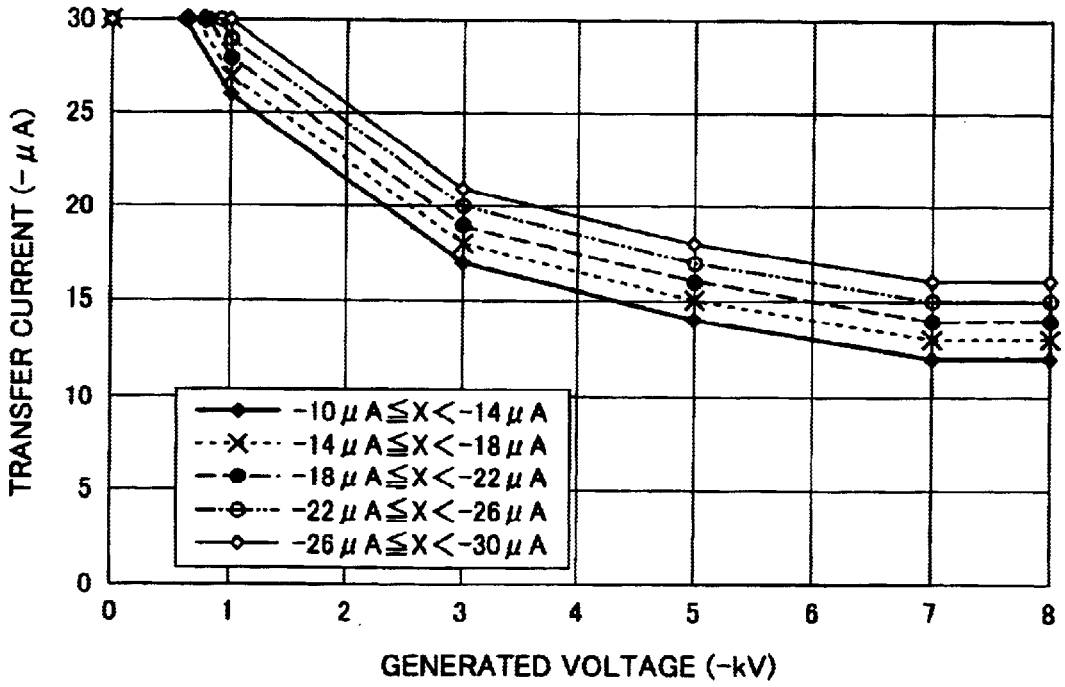
FIG. 9(*a*) is a measurement-current correspondence table for normal thick sheets with widths of 100–70 mm.
Figure 10B:
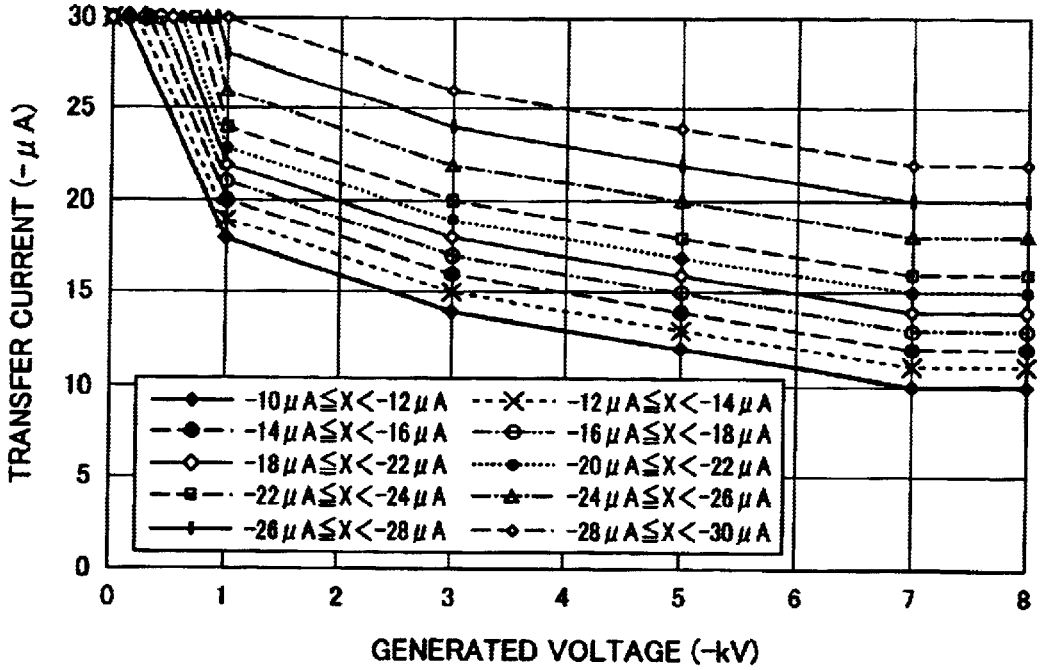
FIG. 10(*a*) is a measurement-current correspondence table for normal thick sheets with widths of 216–191 mm.

FIGS. 9(*a*) and 10(*a*) show two of the fifteen measurement-current correspondence tables. That is, FIG. 9(*a*) shows the measurement-current correspondence table that correspond to the combination of the "normal sheets" and the width of "100–70 mm". FIG. 10(*a*) shows the measurement-current correspondence table that correspond to the combination of the "normal sheets" and the width of "216–191 mm".

More specifically, the ROM 72 stores therein fifteen measurement-current correspondence tables (resistance/bias tables) in correspondence with the fifteen different-types of sheets. Each measurement-current correspondence table has a plurality of columns (subsidiary tables) in correspondence with a plurality of different ranges of the measurement current amount. It is noted that in FIGS. 9(*a*) and 10(*a*), each measurement-current amount range is defined by the inequality "first (left-side) current value≦X<second (right-side) current value". This inequality is intended to mean that the absolute value of the measurement current X is greater than or equal to the absolute value of the first current value and smaller than the absolute value of the second current value.

In this example, the measurement-current correspondence table of FIG. 9(*a*) has five columns (five subsidiary tables) in correspondence with five different ranges of the measurement current amount: a first range where the absolute value of the measurement current amount is greater than or equal to the absolute value of −10 μA and smaller than the absolute value of −14 μA; a second range where the absolute value of the measurement current amount is greater than or equal to the absolute value of −14 μA and smaller than the absolute value of −18 μA; a third range where the absolute value of the measurement current amount is greater than or equal to the absolute value of −18 μA and smaller than the absolute value of −22 μA; a fourth range where the absolute value of the measurement current amount is greater than or equal to the absolute value of −22 μA and smaller than the absolute value of −26 μA; and a fifth range where the absolute value of the measurement current amount is greater than or equal to the absolute value of −26 μA and smaller than or equal to the absolute value of −30 μA.

The measurement-current correspondence table of FIG. 10(*a*) has ten columns (ten subsidiary tables) in correspondence with ten different ranges of the measurement current amount: a first range where the absolute value of the measurement current amount is greater than or equal to the absolute value of −10 μA and smaller than the absolute value of −12 μA; a second range where the absolute value of the measurement current amount is greater than or equal to the absolute value of −12 μA and smaller than the absolute value of −14 μA; a third range where the absolute value of the measurement current amount is greater than or equal to the absolute value of −14 μA and smaller than the absolute value of −16 μA; a fourth range where the absolute value of the measurement current amount is greater than or equal to the absolute value of −16 μA and smaller than the absolute value of −18 μA; a fifth range where the absolute value of the measurement current amount is greater than or equal to the absolute value of −18 μA and smaller than the absolute value of −20 μA; a sixth range where the absolute value of the measurement current amount is greater than or equal to the absolute value of −20 μA and smaller than the absolute value of −22 μA; a seventh range where the absolute value of the measurement current amount is greater than or equal to the absolute value of −22 μA and smaller than the absolute value of −24 μA; an eighth range where the absolute value of the measurement current amount is greater than or equal to the absolute value of −24 μA and smaller than the absolute value of −26 μA; a ninth range where the absolute value of the measurement current amount is greater than or equal to the absolute value of −26 μA and smaller than the absolute value of −28 μA; and a tenth range where the absolute value of the measurement current amount is greater than or equal to the absolute value of −28 μA and smaller than or equal to the absolute value of −30 μA. It is noted that the transfer bias application power supply 81 is configured as being capable of applying the transfer roller 31 with a current whose absolute value is in the range of greater than or equal to the absolute value of −10 μA and smaller than or equal to the absolute value of −30 μA. Thus, the minimum current amount having the minimum absolute value that the transfer bias application power supply 81 can supply to the transfer roller 31 is −10 μA.

In each table, each column lists up a plurality of transfer bias current values in correspondence with a plurality of voltage values. The plurality of voltage values are those values that will possibly be generated by the transfer roller 31 and measured by the voltmeter 78 when the transfer bias application power supply 81 applies the transfer roller 31 with a measuring current of an amount in the range of −10 μA to −30 μA. Each transfer bias current value in each column of each table is an appropriate value that should be applied to the transfer roller 31 in order to perform high quality transfer operation onto a sheet 3 of a corresponding type (thickness-and-width) when the transfer roller 31 generates the corresponding amount of voltage in response to the application of the corresponding measuring current.

It is noted that the tables of FIGS. 9(*a*) and 10(*a*) list up, for all the fifteen voltage values of 0 kV, −0.1 kV, −0.2 kV, . . . , −7 kV, and −8 kV, the transfer bias current values that are plotted on graphs of FIGS. 9(*b*) and 10(*b*), respectively, although some table cells are left blank in the tables of FIGS. 9(*a*) and 10(*a*). That is, in the table of FIG. 9(*a*), a cell for each voltage in each column is listed with such a current value that is shown in the graph of FIG. 9(*b*) as indicated by a point that falls on a line of a corresponding measuring current amount at a corresponding voltage amount position. Similarly, in the table of FIG. 10(*a*), a cell for each voltage in each column is listed with such a current value that is shown in the graph of FIG. 10(*b*) as indicated by a point that falls on a line of a corresponding measuring current amount at a corresponding voltage amount position. For example, although current values are omitted from those cells for the voltages of −0.1 kV to −0.5 kV and of −0.7 kV to −0.9 kV in the column for the measurement current amount of −10 μA to −14 μA in FIG. 9(*a*), these current values are shown in FIG. 9(*b*) as indicated by those points that fall on the most leftside section (range of 0 kV to −1 kV) of a solid line with solid diamond plots.

Figure 8:
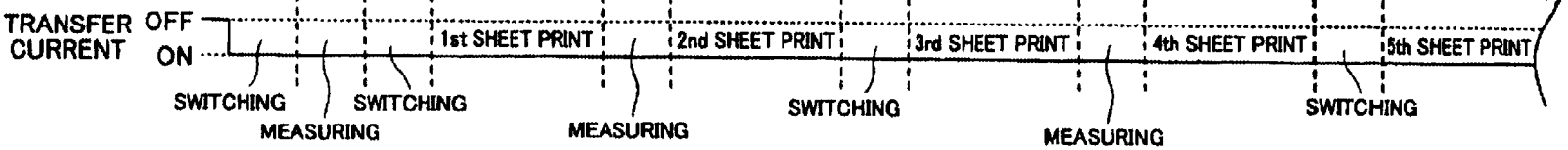
FIG. 8 is a timing chart of a control according to a second modification of the embodiment.

According to the present modification, the CPU 71 performs the measuring operation and the transfer-bias current switching operation according to the control timings shown in FIG. 8.

When a printing process starts, the CPU 71 performs the measuring operation and the transfer-bias current switching operation in the same manner as in the above-described embodiment during the preparation interval (0-th inter-sheet interval), that is, before the transferring operation for the first sheet 3 is started.

That is, the transfer bias application power supply 81 starts applying the transfer roller 31 with a measurement current of the predetermined amount (−10 μA, in this example). Then, the CPU 71 waits for 300 msec so that the measurement current will become stable. Then, the voltmeter 78 measures the voltage 32 times while the transfer roller 31 rotates one rotation. The CPU 71 calculates the average of the 32 number of measurement values, thereby determining the amount of the voltage generated at the transfer roller 31. Based on the determined voltage amount, the CPU 71 selects a transfer bias from the measurement-current amount correspondence tables. For example, if normal sheets 3 with sheet widths 100–70 mn are to be printed, and if the generated voltage amount is calculated as being equal to −3 kV, the CPU 71 selects the measurement-current correspondence table of FIG. 9(*a*), selects a column for measurement current amount range of −10 μA to −14 μA from the selected table of FIG. 9(*a*) because the present measurement current amount is −10 μA, and selects the transfer bias current value of −17 μA from the selected column. The CPU 71 sets the selected value of the transfer bias current to be used for the first transfer operation.

Next, the CPU 71 switches the value of the transfer bias current from the measurement value (−10 μA) into the value that is now being set for the first printing operation. The CPU 71 controls the transfer bias application power supply 81 to apply the transfer bias current of the newly-set value to the transfer roller 31 The CPU 71 then waits for 300 msec so that the newly-applied transfer bias current becomes stable. Thereafter, transfer onto the first sheet 3 starts. During the first sheet transfer process, the CPU 71 applies the transfer roller 31 with the newly-set transfer bias current while maintaining fixed the amount of the transfer bias current. Once transfer onto the first sheet 3 finishes, the first inter-sheet interval of 350 msec is provided before the transfer onto the second sheet 3 starts.

During the first inter-sheet interval, the CPU 71 controls the transfer bias application power supply 81 to continue applying the transfer bias current of the presently-set value to the transfer roller 31 as a measuring current. In this way, the transfer roller 31 is supplied with a measuring current whose amount is equal to that of the transfer bias current used during the first sheet printing operation. The CPU 71 controls the voltmeter 78 to measure the amount of the voltage that is generated by the transfer roller 31 in response to the application of the measuring current. The CPU 71 calculates the average of the measured voltage values, thereby determining the generated voltage value. It takes about 300 msec to measure and determine the voltage value.

After waiting for the remaining period (50 msec) to provide the complete inter-sheet interval of 350 msec, the CPU 71 starts performing the transfer operation onto the second sheet, while applying the transfer roller 31 with the transfer bias current whose amount is equal to that used during the first sheet transfer operation and during the first inter-sheet interval. The CPU 71 maintains the amount of the transfer bias current to be fixed.

When the transfer process onto the second sheet finishes, the second inter-sheet interval of 350 nm is provided before the transfer process onto the third sheet. During the second inter-sheet interval, the amount of the transfer bias current is switched from the present set value into the value that is determined dependently on the result obtained by the measuring operations executed during the first inter-sheet interval.

In this example, during the preparation interval (0-th inter-sheet interval), the amount of the transfer bias current has been set to −17 μA. Accordingly, during the first inter-sheet interval, the CPU 71 executes the measuring operation by supplying a measuring current of −17 μA to the transfer roller 17. The CPU 71 calculates the voltage amount (average voltage amount) generated by the transfer roller 31. It is now assumed that the CPU 71 calculates the generated voltage amount as −3 kV. When the first inter-sheet interval is finished, the transfer operation onto the second sheet is executed while continuing applying the transfer roller 17 with the measuring current of −17 μA which has been set during the preparation interval (0-th inter-sheet interval).

After the transfer process onto the second sheet is finished, during the second inter-sheet interval, the CPU 71 selects an appropriate transfer bias current based on the measurement results obtained during the first inter-sheet interval. In this example, the CPU 71 selects the column in FIG. 9(*a*) for the measuring current amount range of −14 μA is to −18 μA because the measuring current amount used in the first inter-sheet interval is equal to −17 μAm. The CPU 71 selects a transfer bias current of −18 μA that corresponds to the calculated voltage amount of −3 kV in the selected column. The CPU 71 switches the measuring current amount from the value of −17 μA into the newly-selected value of 18 μA.

When the 350 msec period of the second inter-sheet interval has been completed, the transfer process onto the third sheet starts while applying the transfer bias current of −18 μA to the transfer roller 31. When the transfer process onto the third sheet is completed, the third inter-sheet interval is provided, and the voltmeter 78 measures the voltage generated by the transfer roller 31 which is now being supplied with a measuring current of −18 μA, which is equal to the amount of the transfer bias current that has been used during the third sheet transfer process.

In this way, the voltage measuring operation and the transfer-bias current switching operation are executed alternately through the successive series of inter-sheet intervals from the first inter-sheet interval so that the voltage measuring operation is executed during each odd-number-th inter-sheet interval and the transfer-bias current switching operation is executed during each even-number-th inter-sheet interval. The length of each odd-number-th inter-sheet interval and each even-number-th inter-sheet interval is set to the normal length of 350 msec.

Thus, according to the present modification, only during the preparation interval (0-th inter-sheet interval), both of the voltage measuring process and the transfer bias current switching process are executed. Accordingly, the length of the preparation interval (0-th inter-sheet interval) is set to 900 msec. Zn the voltage measuring process, the CPU 71 measures and determines the voltage generated by the transfer roller 31 in response to the application of the predetermined amount of current (−10 μA). In the transfer bias current switching process, the CPU 71 switches the transfer bias current amount into such an amount that is appropriate to the type of the sheets 3 and that corresponds to the generated voltage value, while referring to the measurement-current correspondence tables.

During each i-th sheet transfer process (where i is an integer equal to or greater than one), the transfer process is executed onto the corresponding i-th sheet by applying the transfer roller 31 with the transfer bias current whose amount has been set by a transfer bias current switching process that has been executed latest.

According to the present modification, all the i-th inter-sheet intervals (where i is an integer equal to or greater than one) are classified into: odd-number-th ($i_{odd}$-th) inter-sheet intervals (where $i_{odd}$ is an odd number greater than or equal to one (1)); and even-number-th ($i_{even}$-th) inter-sheet intervals (where $i_{even}$ is an even number greater than one (1)).

During every odd-number-th ($i_{odd}$-th) inter-sheet interval, the voltage measuring process is executed by measuring and determining the voltage that is generated by the transfer roller 31 in response to the application of a measuring current of an amount that is equal to the amount of the transfer bias current that has been used during the latest-executed $i_{odd}$-th sheet transfer process. The length of each odd-number-th ($i_{odd}$-th) inter-sheet interval is set to the normal length of 350 msec.

During every even-number-th ($i_{even}$-th) inter-sheet interval, the transfer bias current switching process is executed by switching the transfer bias current amount into such an amount that is appropriate to the type of the sheets 3 and that corresponds to the generated voltage value that has been measured and determined by the voltage measuring process executed during the latest odd-number-th (($i_{even}$−1)-th) inter-sheet interval, while referring to the measurement-current correspondence tables. The length of every even-number-th ($i_{even}$-th) inter-sheet interval is set to the normal length of 350 msec.

Next, the control process of the present modification will be described in greater detail with referring to the flowchart of FIG. 11.

It is noted that in the control process of the present modification, the processes of S1–S6, and S8–S14 are executed in the same manner as in the processes of S1–S6, and S8–S14 (FIG. 7) in the above-described embodiment.

According to the present modification, in S7', one measurement-current correspondence table that corresponds to the thickness and size of the sheets 3 detected in S6 is selected among the fifteen measurement-current correspondence tables. Also in S7', one column that corresponds to the amount of the measurement current (which is now −10 μA) is selected from the selected measurement-current correspondence table. Also in S7', a current value that corresponds to the measured-and-determined voltage amount is selected from the selected column, and is set as a transfer bias for the printing operation to be executed next.

If the printing job should continue (S12: no), according to the present modification, it is judged in S45 whether or not the total number of printed sheets, which has been counted in S11, is an odd number. If the total number of printed sheets is an odd number (S45: yes), the CPU 71 controls in S46 the voltmeter 78 to measure the voltage generated by the transfer roller 31 32 times, while controlling the transfer bias application power supply 81 to apply a measuring current whose amount is equal to that of a transfer bias current that the transfer bias application power supply 81 has applied to the transfer roller 31 during the latest-executed transfer process. Also in S46, the CPU 71 calculates the average of the 32 number of voltage measurement values. It takes about 300 msec for the CPU 71 to execute the process of S46. After waiting for the remaining time period of 50 msec to complete the inter-sheet interval of 350 msec in S47, the process returns to S10, in which a transfer process is executed.

On the other hand, if the total number of printed sheets is an even number (S45: no), the program proceeds to S48. In S48, in the same manner as in S6, the sheet type detection program is executed to detect the size and thickness of the sheets 3. Then, in S49, an appropriate transfer bias current value is selected in the same manner as in S7' based on the amount of the measuring current that has been used in the measuring process of S46 during the latest executed inter-sheet interval and based on the thickness and size of the sheets detected in S48. Then, in 550, the transfer bias current is switched into the newly-selected value. Then, in S51, the CPU 71 waits for 300 msec so that the transfer bias current of the newly-selected amount becomes stable. Next, in S52, the CPU 71 further waits for the remaining period of 50 msec in order to complete the period of 350 msec for the present inter-sheet interval. Thereafter, the program returns to S10, in which a transfer process is executed by the newly-selected amount of transfer bias current.

In this way, during each inter-sheet interval, either one of the voltage measuring operation and the transfer-bias current switching operation is executed. The voltage measuring operation and the transfer-bias current switching operation are executed alternately through the successive series of inter-sheet intervals. Accordingly, the length of each inter-sheet interval, during which either the voltage measuring operation or the transfer-bias current switching operation is executed, can be set to the normal length of 350 msec. It is therefore possible to enhance the entire printing speed for the consecutive printing process.

More specifically, according to the present embodiment, the ROM 72 stores therein a plurality of measurement-current correspondence columns (subsidiary tables) in correspondence with the plurality of measurement-current amount ranges. During the measuring process to measure the voltage generated by the transfer roller 31, the CPU 71 applies the transfer roller 71 with a measuring current whose amount is equal to that of a transfer bias current, which the CPU 71 has applied to the transfer roller 71 during a transfer process that the CPU 71 has executed immediately prior to the measuring process. It is unnecessary to switch the amount of the transfer bias current back to the predetermined measurement amount (−10 $\mu$A). Accordingly, it is unnecessary to wait until the switched current becomes stable before starting the measuring operation. It is therefore unnecessary to set the length of the inter-sheet interval, during which the measuring operation is executed, to a value longer than the normal length.

According to this modification, the ROM 72 stores therein fifteen measurement-current correspondence tables in correspondence with the fifteen types (fifteen combinations of size and thickness) of the sheets 3. In each measurement-current correspondence table, a plurality of columns (subsidiary tables) are stored in correspondence with a plurality of measurement current amount ranges. In each column (subsidiary table), a plurality of transfer bias values are listed in correspondence with a plurality of amounts of voltages, which will possibly be generated by the transfer roller 31 in response to application of the measuring current in the corresponding amount range. The CPU 71 selects, among the plurality of measurement-current correspondence tables, one table that corresponds to the size and thickness of sheets 3 to be printed. It is possible to select the amount of bias current that appropriately corresponds to the size and thickness of sheets 3 and to the resistance value of the transfer roller 31, by simply selecting, from the selected table, one transfer bias current amount that corresponds to the presently-measured voltage and to the amount of the measuring current. It is therefore possible to apply the transfer roller 31 with a transfer bias that corresponds to the size and thickness of sheets 3 and that corresponds to the resistance of the transfer roller 31. It is possible to attain an ideal transfer operation with a constant current control.

Third Modification

According to the present modification, the transfer bias current switching timings when the amount of the transfer bias current should be changed is determined in advance, and the amount of the change in the transfer bias current is also determined in advance. More specifically, when the number of printed sheets reaches either one of several predetermined numbers (which will be referred to as "trigger sheet numbers" hereinafter), then the amount of the transfer bias current is changed by an amount that is determined in advance in correspondence with the printed sheet number.

It is noted that the trigger sheet numbers are predetermined sheet numbers that trigger change in the transfer bias current. In this example, the trigger sheet numbers are one, two, three, four, five, seven, ten, twenty, thirty, fifty, and one hundred.

According to this modification, the ROM 72 stores therein a plurality of (fifteen) sheet-number correspondence tables in correspondence with a plurality of (fifteen) types (size-and-thickness combinations) of sheets 3. One of the sheet-number correspondence tables is shown in FIG. 12. The sheet-number correspondence table has a plurality of rows (subsidiary tables) in correspondence with a plurality of different voltage ranges. Voltages in the plurality of voltage ranges are those values that will possibly be generated and measured by the transfer roller 31 when the transfer roller 31 is applied with the measuring current of the predetermined amount (−10 $\mu$A) during the preparation interval 0-th inter-sheet interval).

It is noted that in FIG. 12, which voltage range is defined as being greater than or equal to a corresponding first (left-side) voltage value and less than a corresponding second (right-side) voltage value. This definition is intended to mean that the absolute value of a voltage in each voltage range is greater than or equal to the absolute value of the corresponding first (left-side) voltage value and less than the absolute value of the corresponding second (right-side) voltage value. In this example, the sheet-number correspondence table of FIG. 12 has eight rows (eight subsidiary tables) in correspondence with eight different voltage ranges: a first range where the absolute value of the generated voltage is greater than or equal to the absolute value of −1 kv and smaller than the absolute value of −2 kV; a second range where the absolute value of the generated voltage is greater than or equal to the absolute value of −2 kv and smaller than the absolute value of −3 kV; a third range where the absolute value of the generated voltage is greater than or equal to the absolute value of −3 kV and smaller than the absolute value of −4 kV; a fourth range where the absolute value of the generated voltage is greater than or equal to the absolute value of −4 kV and smaller than the absolute value of −5 kV; a fifth range where the absolute value of the generated voltage is greater than or equal to the absolute value of −5 kV and smaller than the absolute value of −6 kV; a sixth range where the absolute value of the generated voltage is greater than or equal to the absolute value of −6 kV and smaller than the absolute value of −7 kV; a seventh range where the absolute value of the generated voltage is greater than or equal to the absolute value of −7 kV and smaller than the absolute value of −8 kV; and an eighth range where the absolute value of the generated voltage is greater than or equal to the absolute value of −8 kV and smaller than the absolute value of −9 kV.

Each row (each subsidiary table) lists up a plurality of current amounts in correspondence with the plurality of trigger sheet numbers. Each current amount is a value that should be added to the amount of a transfer bias current that has been applied to the transfer roller 31 during a transfer process for the sheet of the corresponding sheet number.

According to this modification, when the printing process starts, during the preparation interval (0-th inter-sheet interval), the voltage measuring operation and the transfer-bias current switching operation are executed in the same manner as in the above-described embodiment. That is, first, the measuring current of the predetermined amount (−10 μA) is supplied to the transfer roller 31, and the voltage generated by the transfer roller 31 is measured 32 times. The average value of the obtained 32 number of measured data is calculated to obtain the value of the generated voltage. Then, the sheet-width correspondence tables of FIGS. 3(*a*)–5(*a*) are referred to, and a transfer-bias current amount is selected from the sheet-width correspondence tables based on the generated voltage value and the size and thickness of the sheets 3. The thus selected transfer bias current is set as an initial transfer bias current.

Figure 13:
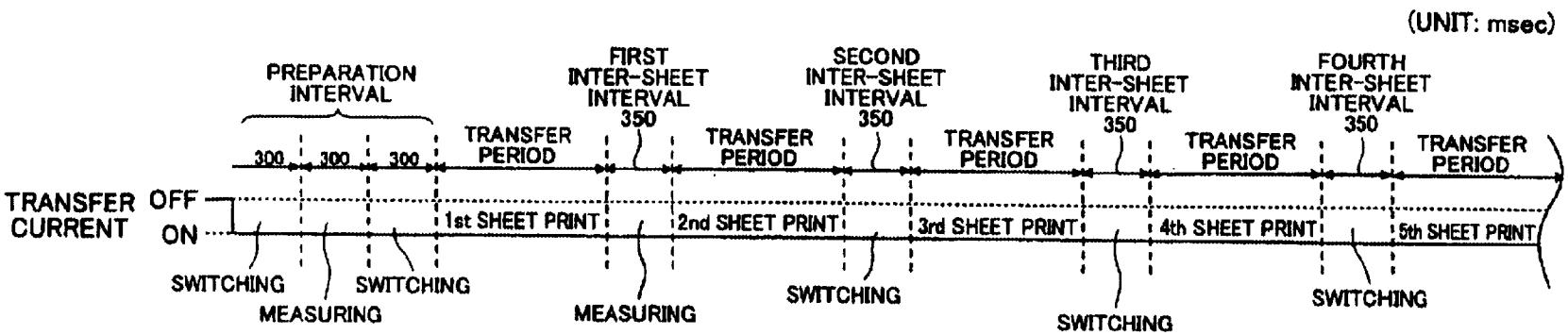
FIG. 13 is a timing chart of a control according to a third modification of the embodiment.

According to the present modification, the CPU 71 performs the measuring operation and the transfer-bias current switching operation according to the control timings shown in FIG. 13.

When a printing process starts, the CPU 71 performs the measuring operation and the transfer-bias current switching operation in the same manner as in the above-described embodiment during the preparation interval (0-th inter-sheet interval), that is, before the transferring operation for the first sheet 3 is started.

That is, the transfer bias application power supply 81 starts applying the transfer roller 31 with a measurement current of the predetermined amount (−10 μA, in this example). Then, the CPU 71 waits for 300 msec so that the measurement current will become stable. Then, the voltmeter 78 measures the voltage 32 times while the transfer roller 31 rotates one rotation. The CPU 71 calculates the average of the 32 number of measurement values, thereby determining the amount of the voltage generated at the transfer roller 31. Based on the determined voltage amount, the CPU 71 selects a transfer bias from the sheet-width correspondence tables of FIGS. 3(*a*)–5(*a*). It is now assumed that normal sheets 3 with width of 216–191 mm are to be printed and that the generated voltage value is calculated as −7 kV. In this case, the CPU 71 selects the sheet-width correspondence table of FIG. 3(*a*), selects a column for sheet width 216–191 mm from the selected table of FIG. 3(*a*), and selects the transfer bias current value of −10 μA from the column of sheet width 216–191 mm in FIG. 3(*a*). The CPU 71 switches the amount of the transfer bias current into the thus selected value (−10 μA) for the first printing operation.

As a result, the CPU 71 executes the transfer operation onto the first sheet by applying the transfer roller 31 with the thus selected amount (−10 μA) of transfer bias current and by maintaining the amount of the transfer bias current to be fixed at the selected amount.

When the first sheet transfer process ends, the first inter-sheet interval of 350 msec is provided. During the first inter-sheet interval, the CPU 71 refers to the sheet-number correspondence table of FIG. 12, and selects one row (seventh row, in this example) that corresponds to the seventh voltage range that contains the generated voltage value of −7 kV that has been determined during the preparation interval (0-th inter-sheet interval). Because the total number of the already printed sheets is one and is equal to the trigger sheet number (1), the CPU 71 selects the current value of (−0.5 μA) that corresponds to the trigger sheet number (1) from the selected row. The CPU 71 adds the selected current value of (−0.5 μA) to the transfer bias current of (−10 μA) that has been used during the first sheet transfer process.

Then, the CPU 71 executes the transfer process onto the second sheet while applying the transfer roller 31 with the newly-determined transfer bias current of (−10.5 μA) and while maintaining the amount of the transfer bias current to be fixed at this value.

After the transfer process for the second sheet is completed, the second inter-sheet interval of 350 msec is provided. During the second inter-sheet interval, the CPU 71 again refers to the selected row (subsidiary table) that corresponds to the initially-generated voltage value of −7 kV in the sheet-number correspondence table of FIG. 12. Because the total number of the already printed sheets is now two and is equal to the trigger sheet number (2), the CPU 71 selects the current value of (−0.5 μA) that corresponds to the trigger sheet number (2) from the selected row. The CPU 71 adds the selected current value of (−0.5 μA) to the transfer bias current of (−10.5 μA) that has been used during the second sheet transfer process.

Then, the CPU 71 executes the transfer process onto the third sheet while applying the transfer roller 31 with the newly-determined transfer bias current of (−11 μA) and maintaining the amount of the transfer bias current to be fixed.

After the transfer process for the third sheet is completed, the third inter-sheet interval of 350 msec is provided. During the third inter-sheet interval, the CPU 71 adds −0.5 μA to the present transfer bias current of (−11 μA) to obtain −11.5 μA. The CPU 71 executes the fourth-sheet transfer process by using the transfer bias current of −11.5 μA.

After the transfer process for the fourth sheet is completed, the fourth inter-sheet interval of 350 msec is provided. During the fourth inter-sheet interval the CPU 71 adds −0.5 μA to the present transfer bias current of (−11.5 μA) to obtain −12 μA. The CPU 71 executes the fifth-sheet transfer process by using the transfer bias current of −12 μA.

After the transfer process for the fifth sheet is completed, the fifth inter-sheet interval of 350 msec is provided. During the fifth inter-sheet interval, the CPU 71 adds −0.5 μA to the present transfer bias current of (−12 μA) to obtain −12.5 μA. The CPU 71 executes the sixth-sheet transfer process by using the transfer bias current of 12.5 μA.

It is noted, however, that the sheet trigger numbers do not include "six". Accordingly, during the sixth inter-sheet interval, the CPU 71 adds no amount to the present transfer bias current of (−12.5 μA). Accordingly, the CPU 71 executes the seventh-sheet transfer process by using the transfer bias current of −12.5 μA.

After the transfer process for the seventh sheet is completed, the seventh inter-sheet interval of 350 msec is provided. During the seventh inter-sheet interval, the CPU 71 adds −0.3 μA to the present transfer bias current of (−12.5 μA) to obtain −12.8 μA. The CPU 71 executes the eighth-sheet transfer process by using the transfer bias current of −12.8 μA.

In this way, every time when the printed sheet number reaches the trigger sheet number, the current value that is stored in the sheet-number correspondence table in correspondence with the trigger number is added to the transfer bias current amount that has been used during the latest-executed transfer process. The transfer bias current of the thus created new amount will be used during the next transfer process.

It is noted in FIG. 12, in the rows for the generated voltage values of −1 to −2 kv, −2 to −3 kV, and −3 to −4 kV, some cells are left blank to indicate that that no current value should be added to the latest-used transfer bias current. For example, if −1 kV is determined by the measuring process during the preparation interval (0-th inter-sheet interval), the value of the transfer bias current will not be changed until 100 sheets are printed. After the 100-th sheet is printed, during the $100^{th}$ inter-sheet interval, the transfer bias current is added with −0.1 μA.

Thus, according to the present modification, only during the preparation interval (0-th inter-sheet interval) that is provided immediately before the first sheet transfer process, both of the voltage measuring process and the transfer bias current switching process are executed. Accordingly, the length of the preparation interval (0-th inter-sheet interval) is set to 900 msec. In the voltage measuring process, the CPU 71 measures and determines the voltage generated by the transfer roller 31 in response to the application of the predetermined amount of current (−10 μA). In the transfer bias current switching process, the CPU 71 switches the transfer bias current amount into such an amount that is appropriate to the type of the sheets 3 and that corresponds to the generated voltage value, while referring to the sheet-width correspondence tables of FIGS. 3(*a*)–5(*a*).

During each i-th sheet transfer process (where i is an integer equal to or greater than one), the transfer process is executed onto the corresponding i-th sheet by applying the transfer roller 31 with the transfer bias current whose amount has been set by a transfer bias current switching process that has been executed latest before the subject i-th sheet transfer process.

According to the present modification, all the i-th inter-sheet intervals (where i is an integer equal to or greater than one) are classified into: m-th inter-sheet intervals (where m is an integer different from the trigger sheet numbers (1, 2, 3, 4, 5, 7, 10, 20, 30, 50, and 100); and p-th inter-sheet intervals (where p is an integer equal to the trigger sheet numbers (1, 2, 3, 4, 5, 7, 10, 20, 30, 50, and 100).

During every m-th inter-sheet interval, no voltage measuring process or no transfer bias current switching process is executed. The length of each m-th inter-sheet interval is set to the normal length of 350 msec.

During every p-th inter-sheet interval, the transfer bias current switching process is executed. The length of every p-th inter-sheet interval is set to the normal length of 350 msec. During every p-th inter-sheet interval, the transfer bias current switching process is executed by adding, to a transfer bias current amount that has been used in the p-th sheet transfer process immediately before the subject p-th inter-sheet interval, such an amount that is appropriate to the type of the sheets 3 and that corresponds to the generated voltage value measured and determined during the preparation interval (0-th inter-sheet interval), while referring to the sheet-number correspondence tables.

Figure 14:
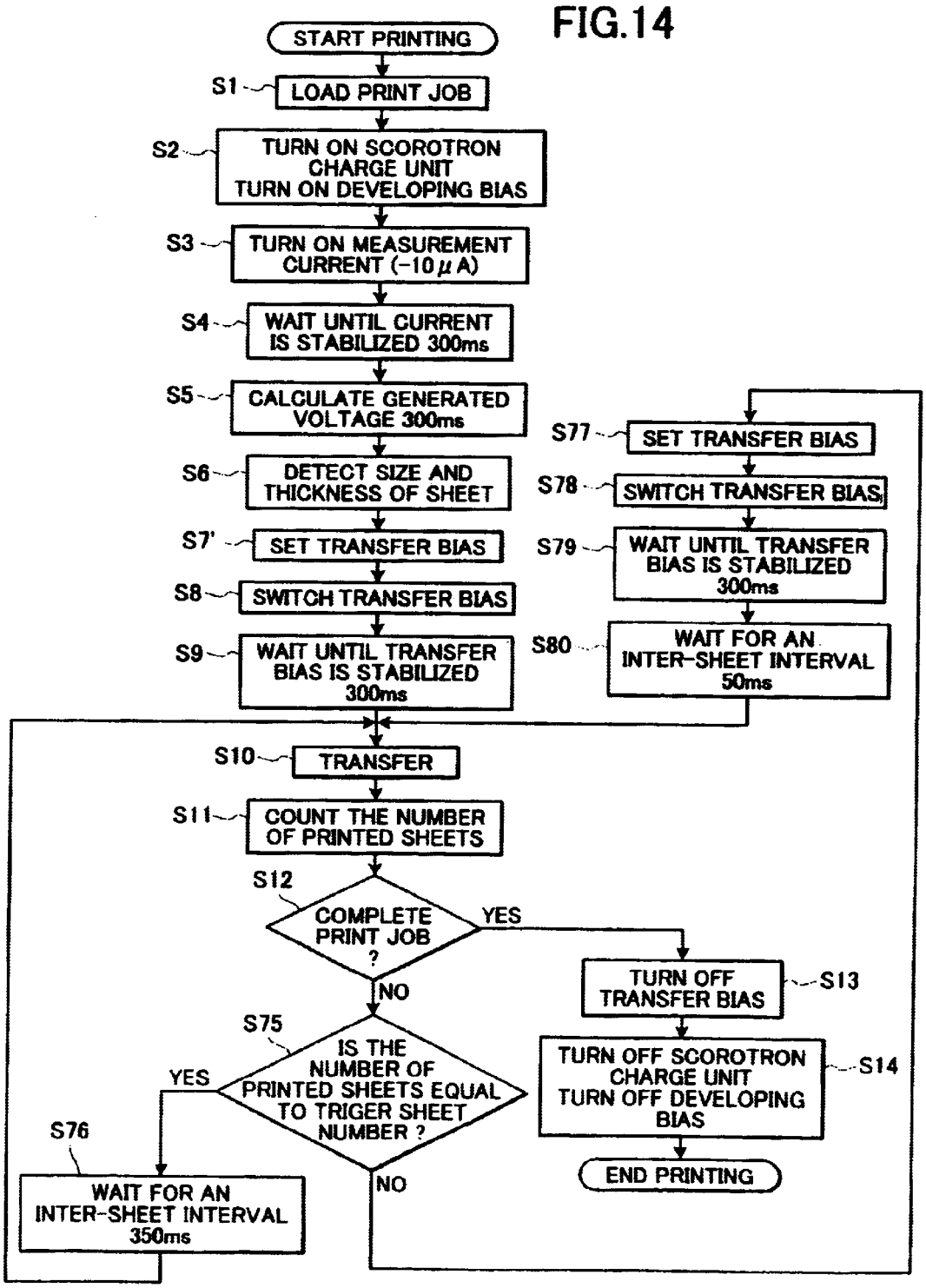
FIG. 14 is a flowchart of the control process according to the third modification of the embodiment

Next, the control process of the present modification will be described in greater detail with referring to the flowchart of FIG. 14.

It is noted that in the control process of the present modification, the processes of S1–S14 are executed in the same manner as in the processes of S1–S14 (FIG. 7) in the above-described embodiment.

According to the present modification, if the printing job should continue (S12: no), it is judged in S75 whether or not the total number of the printed sheets, which has been counted in S11, is either one of the plurality of trigger sheet numbers (1, 2, 3, 4, 5, 7, 10, 20, 30, 50, and 100). If the total number of printed sheets is not equal to any trigger sheet number (S75: no), the CPU 71 waits for 350 msec in S76 to provide the inter-sheet interval of 350 msec, and the program returns to S10, in which the transfer process is executed while applying the transfer roller 31 with the transfer bias current whose amount is the same as that used during the latest-executed transfer process.

On the other hand, if the total number of printed sheets is equal to some trigger sheet number (S75: yes), the program proceeds to S77. In S77, the CPU 71 selects one sheet-number correspondence table that corresponds to the size and thickness of the sheets 3 that has been detected in S6. Also in S77, the CPU 71 selects, from the selected sheet-number correspondence table, one row that corresponds to the generated voltage value that has been calculated in S5 during the preparation interval (0-th inter-sheet interval). The CPU 71 selects, from the selected row, one current value that corresponds to the printed sheet number that has been counted in S11. The CPU 71 adds the selected current value to the value of the transfer bias current that has been used during the latest-executed transfer process, thereby determining the amount of the transfer bias current to be used during the next transfer process.

Then, in S78, the CPU 71 switches the amount of the transfer bias current into the newly-determined amount. Then, in S79, the CPU 71 waits for 300 msec until the newly-applied transfer bias current becomes stable. In S80, the CPU 71 further waits for the remaining period of 50 msec to provide the complete inter-sheet interval of 350 msec. Then, the program returns to S10, in which the transfer process is executed by the newly-changed transfer bias current.

It is noted that the temperature within the laser printer 1 gradually rises as the number of printed sheets increases during consecutive printing. This is due to heat generated by the thermal roller 47 located in the fixing section 23. The resistance value of the transfer roller 31 gradually decreases as the temperature rises.

It is possible to predict how the temperature will rise in the device 1 based on experiences. It is therefore possible to predict the temperature of the device 1 obtained when the printed sheet number reaches each of the plurality of predetermined numbers (trigger sheet numbers). It is possible to predict the resistance of the transfer roller 31 at the predicted temperature. It is possible to determine an appropriate amount of transfer bias current to be applied to the transfer roller 31 of the predicted resistance. Accordingly, it is possible to prepare in advance the plurality of sheet-number correspondence rows (subsidiary tables) in correspondence with the plurality of voltage amounts that indicate a plurality of resistance values that the transfer roller 31 will possibly possess at the beginning of the printing process. Each row (subsidiary table) lists up a plurality of appropriate transfer bias current amounts in correspondence with the plurality of trigger sheet numbers. According to the present modification, the voltage generated by the transfer roller 31 is measured at the beginning of the printing process. One row that corresponds to the measured voltage is selected from the sheet-number correspondence table. It is possible to apply the transfer roller 31 with an appropriate transfer bias current that corresponds to the rising temperature in the laser printer 1 by successively changing the transfer bias current in the selected single row.

Additionally, the transfer-bias current amount changing timing and the changing amount change dependently on the voltage value that is determined in the beginning of the printing process. Therefore, it is possible to apply the transfer roller 31 with an appropriate transfer bias current that corresponds to the temperature rise inside the laser printer 1 and that corresponds to the initial resistance value of the transfer roller 31.

Fourth Modification

Controls in the above-described embodiment and in the above-described modifications can be combined with one another. According to the present modification, in the initial stage of the consecutive printing, the control of the first modification is executed so that both of the voltage measuring operation and the transfer-bias current switching operation are executed every time after one sheet has been printed. When a predetermined number of sheets have been printed, the control of the second modification is executed so that the voltage measuring operation and the transfer-bias current switching operation are executed alternately through the successive series of inter-sheet intervals so that either one of the voltage measuring operation and the transfer-bias current switching operation is executed during each inter-sheet interval.

When the consecutive printing operation is started, during the initial or first stage of the consecutive printing, the temperature inside the device 1 rises rapidly due to the heat generated from the fixing section 23. Accordingly, the resistance of the transfer roller 31 changes rapidly. According to the present modification, the voltage (resistance) of the transfer roller 31 is measured every time after one sheet has been printed during the initial period of the consecutive printing. It is possible to perform transfer process onto each sheet while applying the transfer roller 31 with a transfer bias current whose amount is appropriate for the present resistance of the transfer roller 31. Contrarily, during the final period of the consecutive printing, the temperature inside the device 1 becomes nearly stable. Accordingly, it is unnecessary to measure the voltage (resistance) of the transfer roller 31 every time after one sheet has been printed. By executing the measuring operation and the switching operation alternately, it is possible to shorten the length of every inter-sheet interval during the final stage of the consecutive printing. It is possible to enhance the entire printing speed.

It is noted that in all the embodiment and modifications, during the preparation interval (0-th inter-sheet interval), in order to measure the resistance of the transfer roller 31, the transfer roller 31 is applied with the measuring current of the predetermined amount of $-10\ \mu A$, which has the minimum absolute value in the current range ($-10\ \mu A$ to $-30\ \mu A$) that the transfer bias application supply 81 can apply to the transfer roller 31. Accordingly, it is possible to prevent an excessive amount of current from being applied to the transfer roller 31. It is possible to enhance the durability of the transfer roller 31.

While the invention has been described in detail with reference to the specific embodiment thereof, it would be apparent to those skilled in the art that various changes and modifications may be made therein without departing from the spirit of the invention.

For example, in the above-described embodiment and modifications, the voltmeter 78 is used to measure the voltage generated by the transfer roller 31 in order to obtain information on the resistance of the transfer roller 31. However, the resistance of the transfer roller 31 may be measured by other various manners. For example, it is possible to measure the resistance value of the transfer roller 31 directly by connecting a resistance-measuring electrode to the transfer roller 31.

In the above-described embodiment and modifications, positively-charged toner is used in the laser printer 1. However, negatively-charged toner can also be used in the laser printer 1 by changing the polarity of the bias applied to each section in the laser printer 1 into the opposite polarity from that described in the above-described embodiment and modifications.

The present invention can be applied not only to laser printers but also to other various types of image forming apparatuses.

What is claimed is:

1. An image forming apparatus, comprising:

an image bearing unit bearing a developing agent image thereon;

a transfer unit transferring, at a transfer position, the developing agent image from the image bearing unit to a recording medium;

a bias applying unit capable of applying a transfer bias current to the transfer unit while maintaining fixed the amount of the transfer bias current;

a measuring unit measuring a resistance of the transfer unit;

a type detecting unit detecting a type of the recording medium; and a control unit determining the amount of the transfer bias current, based on the detected recording medium type and on the measured resistance value, the control unit controlling the bias applying unit to apply the determined transfer bias current to the transfer unit.

2. An image forming apparatus as claimed in claim 1, wherein the transfer unit transfers successive developing agent images onto successive sheets of the recording medium, the control unit controlling the measuring unit to measure the resistance of the transfer unit by the time when the transfer unit starts transferring the first developing agent image onto the first sheet of the recording medium.

3. An image forming apparatus as claimed in claim 1, wherein the transfer unit transfers successive developing agent images onto successive sheets of the recording medium, the control unit controlling the measuring unit to measure the resistance of the transfer unit every time when the transfer unit has transferred a predetermined number of developing agent images onto the predetermined number of sheets of the recording medium.

4. An image forming apparatus as claimed in claim 1, further comprising a medium-type detecting unit detecting the type of the recording medium, onto which the developing agent image is to be transferred, wherein the control unit controls the measuring unit to measure the resistance of the transfer unit when the medium-type detecting unit detects that the type of the recording medium is changed.

5. An image forming apparatus as claimed in claim 1, further comprising a transport unit transporting each sheet of the recording medium to the transfer position, wherein the transfer unit performs transfer operations in succession to transfer successive developing agent images onto successive sheets of the recording medium, an inter-sheet interval being defined as a period after a trailing edge of one sheet of recording medium that has been subjected to a transfer operation has departed from the transfer position and before a leading edge of the next sheet of recording medium to be subjected to the next transfer operation reaches the transfer position, and wherein the control unit performs, during at least one inter-sheet interval, at least one of a measuring operation and a switching operation, the measuring operation being for controlling the measuring unit to measure the resistance of the transfer unit and determining the amount of the transfer bias current based on the measured result, the switching operation being for switching the amount of the transfer bias current into the determined amount.

6. An image forming apparatus as claimed in claim 5, wherein either one of the measuring operation and the switching operation is executed during one inter-sheet interval.

7. An image forming apparatus as claimed in claim 6, wherein the control unit executes the measuring operation and the switching operation alternately through successive series of the inter-sheet intervals, each inter-sheet interval being defined between corresponding two successive transfer processes.

8. An image forming apparatus as claimed in claim 5, wherein the control unit executes both of the measuring operation and the switching operation during one inter-sheet interval by executing the measuring operation and the switching operation in this order.

9. An image forming apparatus as claimed in claim 8, wherein a length of the inter-sheet interval, during which the control unit executes both of the measuring operation and the switching operation, is longer than a length of another inter-sheet interval, during which no measuring operation or no switching operation is executed.

10. An image forming apparatus as claimed in claim 5, wherein the control unit executes both of the measuring operation and the switching operation during an initial interval, which is defined before the transfer unit transfers the first developing agent image onto the first sheet of recording medium.

11. An image forming apparatus as claimed in claim 1, wherein the measuring unit is capable of measuring the resistance of the transfer unit by applying a predetermined amount of measuring current to the transfer unit, further comprising a memory storing a resistance/bias table listing a correspondence between a plurality of resistance values and a plurality of transfer bias current amounts, the plurality of resistance values corresponding to the predetermined amount of measuring current, wherein the control unit includes a selecting unit selecting, from the resistance/bias table, one transfer bias current amount that corresponds to the measured resistance, thereby determining the amount of the transfer bias current.

12. An image forming apparatus as claimed in claim 11, wherein the memory stores therein a plurality of resistance/bias tables in correspondence with a plurality of types of recording medium.

13. An image forming apparatus as claimed in claim 12, wherein the plurality of types of recording medium are defined by their sizes.

14. An image forming apparatus as claimed in claim 12, wherein the plurality of types of recording medium are defined by their thicknesses.

15. An image forming apparatus as claimed in claim 11, wherein the measuring unit is capable of measuring the resistance of the transfer unit by applying the transfer unit with each of a plurality of predetermined amounts of measuring current, and wherein the memory stores therein a plurality of resistance/bias tables in correspondence with the plurality of predetermined amounts of measuring current.

16. An image forming apparatus as claimed in claim 1, further comprising a memory storing a plurality of sheet number/bias tables in correspondence with a plurality of resistance values, each sheet number/bias table listing a correspondence between a plurality of numbers of sheets and a plurality of transfer bias current amounts, wherein the control unit includes:

a table selecting unit selecting, from the sheet number/bias tables, one sheet number/bias table corresponding to the measured resistance value; and a bias selecting unit selecting, from the selected sheet number/bias table, a transfer bias current amount that corresponds to the total number of sheets of the recording medium that have been subjected to a transfer operation, thereby determining the amount of the transfer bias current to be applied for the transfer operation to be executed next.

17. An image forming apparatus as claimed in claim 1, wherein the control unit controls the measuring unit to measure an amount of voltage that the transfer unit generates when the control unit controls the bias applying unit to apply a measuring current to the transfer unit.

18. An image forming apparatus as claimed in claim 17, wherein the control unit controls the measuring unit to measure the amount of the voltage the transfer unit generates when the control unit controls the bias applying unit to apply the transfer unit with a measuring current of a predetermined fixed amount.

19. An image forming apparatus as claimed in claim 17, wherein the transfer unit performs transfer operations in succession to transfer successive developing agent images onto successive sheets of the recording medium, and wherein the control unit controls the bias applying unit and the measuring unit to perform measuring operation during at least one interval that is defined after the transfer unit has performed one transfer operation to transfer one developing agent image onto one sheet of recording medium, the control unit controlling the bias applying unit to apply the transfer unit with a measuring current of an amount that is equal to that of a transfer bias current which the bias applying unit has applied to the transfer unit during the latest-executed transfer operation, the control unit controlling the measuring unit to measure an amount of a voltage generated by the transfer unit in response to the application of the measuring current.

20. An image forming apparatus as claimed in claim 17, wherein the transfer unit performs transfer operations in succession to transfer successive developing agent images onto successive sheets of the recording medium, wherein the bias applying unit is capable of applying the transfer unit with a transfer bias current whose amount is either one of a plurality of predetermined amounts, the plurality of predetermined amounts including a predetermined minimum amount whose absolute value is lower than the absolute values of all the other remaining predetermined amounts, and wherein the control unit controls the bias applying unit and the measuring unit to perform a first measuring operation before the transfer unit starts transfer operation for transferring the first developing agent image onto the first sheet of the recording medium, the control unit controlling the bias applying unit to apply the transfer unit with a measuring current whose amount is equal to the predetermined minimum amount for the first measuring operation, the control unit controlling the measuring unit to measure an amount of a voltage generated by the transfer unit in response to the application of the measuring current of the predetermined minimum amount.

21. An image forming apparatus as claimed in claim 1, wherein the transfer unit includes a transfer roller.

22. An image forming apparatus as claimed in claim 21, wherein the transfer roller is of an ionic conductive type.

* * * * *